US011505394B2

(12) United States Patent
Callinan et al.

(10) Patent No.: US 11,505,394 B2
(45) **Date of Patent: *Nov. 22, 2022**

(54) BEVERAGE CONTAINER ENCLOSURE

(71) Applicant: BottleKeeper, LLC, Houston, TX (US)

(72) Inventors: Adam Callinan, El Segundo, CA (US); Matthew T. Campbell, Phoenix, AZ (US); David-Henry Oliver, Cambridge, MA (US)

(73) Assignee: BottleKeeper, LLC, Houston, TX (US)

( * ) Notice: Subject to any disclaimer, the term of this patent is extended or adjusted under 35 U.S.C. 154(b) by 60 days.

This patent is subject to a terminal disclaimer.

(21) Appl. No.: 17/113,370

(22) Filed: Dec. 7, 2020

(65) Prior Publication Data

US 2021/0114795 A1 Apr. 22, 2021

Related U.S. Application Data

(63) Continuation of application No. 16/440,603, filed on Jun. 13, 2019, now Pat. No. 10,974,889.
(Continued)

(51) Int. Cl.
*B65D 81/38* (2006.01)
*B65D 47/28* (2006.01)

(52) U.S. Cl.
CPC ..... *B65D 81/3881* (2013.01); *B65D 47/286* (2013.01); *B65D 81/3886* (2013.01)

(58) Field of Classification Search
CPC ..... B65D 81/3876; B65D 81/3881; B65D 81/3883; B65D 81/3886; B65D 43/0225;
(Continued)

(56) References Cited

U.S. PATENT DOCUMENTS 3,717,282 A 2/1973 Nordskog
3,977,559 A 8/1976 Lombardi
(Continued)

FOREIGN PATENT DOCUMENTS

CN 201309656 Y 9/2009
DE 2304777 A1 8/1974
(Continued)

OTHER PUBLICATIONS

International Search Report and Written Opinion issued in corresponding International Application No. PCT/US2019/037043, dated Sep. 26, 2019, 15 pages.

*Primary Examiner* — Steven A. Reynolds
*Assistant Examiner* — Javier A Pagan
(74) *Attorney, Agent, or Firm* — Quarles & Brady LLP

(57) ABSTRACT

A container enclosure for removably enclosing a container is provided. The enclosure includes a base component comprising an outer shell having a base wall and a sidewall extending upwardly therefrom, a support ring, and an interior sleeve. The enclosure further includes a cap component having a lower annular wall and a gasket. The gasket is disposed within a second cavity defined by the cap, and the gasket includes an aperture that is aligned with an opening of the cap component. The lower wall of the cap is configured to be inserted into the first cavity of the base component and the cap component is configured to be removably attached to the base component. The support ring is disposed around an upper end of the interior sleeve and configured to removably couple the interior sleeve to the outer shell. The interior sleeve is configured to receive a beverage container.

21 Claims, 29 Drawing Sheets

Related U.S. Application Data

(60) Provisional application No. 62/684,638, filed on Jun. 13, 2018.

(58) Field of Classification Search
CPC .... B65D 43/0229; B65D 47/00; B65D 47/04; B65D 47/06; A47G 23/02; A47G 23/0266
USPC ..... 206/817
See application file for complete search history.

(56) References Cited

U.S. PATENT DOCUMENTS

D262,439 S 12/1981 Atkinson et al.
D263,024 S 2/1982 Atkinson et al.
4,361,250 A 11/1982 Foster
D275,834 S 10/1984 Slade
4,629,088 A 12/1986 Durgin
D290,688 S 7/1987 Moloney et al.
4,782,964 A 11/1988 Poore et al.
4,790,444 A 12/1988 Terzi
4,809,874 A 3/1989 Pehr
4,927,047 A 5/1990 Stuber et al.
4,932,225 A 6/1990 Bighouse
D310,025 S 8/1990 Foley
4,949,865 A 8/1990 Turner
4,982,855 A 1/1991 Hertrampf
4,989,746 A 2/1991 Pierce
5,031,784 A 7/1991 Wright
D324,492 S 3/1992 Nickerson
D324,493 S 3/1992 Nickerson
5,110,002 A 5/1992 Tucker
5,145,646 A 9/1992 Tyranski
5,203,467 A 4/1993 Tucker
D343,579 S 1/1994 Halasz et al.
5,305,900 A 4/1994 Maguire et al.
D353,336 S 12/1994 Caliendo et al.
D353,337 S 12/1994 Halasz et al.
5,458,232 A 10/1995 Novak et al.
5,462,189 A 10/1995 Pierce
D370,632 S 6/1996 Stonehouse
D370,633 S 6/1996 Stonehouse
D371,075 S 6/1996 Stonehouse
5,740,940 A 4/1998 Weiss
5,762,228 A 6/1998 Morgan et al.
D404,974 S 2/1999 Kristinik
5,971,232 A 10/1999 Rohr et al.
D432,015 S 10/2000 Holiday
6,155,452 A * 12/2000 Laurent ..... B65D 81/3876 220/737
D441,172 S 4/2001 Snyder
D444,385 S 7/2001 Dixon, I
D451,027 S 11/2001 Dugrot
RE38,816 E 10/2005 Baudin
D513,939 S 1/2006 Leonzo
D519,313 S 4/2006 Ringuet
D522,880 S 6/2006 Fuller et al.
D526,308 S 8/2006 Kasden
D530,685 S 10/2006 Dupuis
D531,055 S 10/2006 Munn
D537,736 S 3/2007 Munn
D568,151 S 5/2008 Moffat et al.
D578,392 S 10/2008 Khalil
D589,757 S 4/2009 Mancha, Jr. et al.
D589,758 S 4/2009 Mancha et al.
D590,212 S 4/2009 Mancha, Jr. et al.
D605,060 S 12/2009 Reimer
7,753,240 B2 7/2010 Leoncavallo et al.
D623,963 S 9/2010 Fairchild, Jr. et al.
D641,239 S 7/2011 Ramsey et al.
D641,622 S 7/2011 Fields
D647,400 S 10/2011 Fields
D649,049 S 11/2011 Fields
D653,538 S 2/2012 Toms et al.
D668,154 S 10/2012 Milne et al.
D671,843 S 12/2012 Plosky et al.
D672,235 S 12/2012 Chapin
D688,553 S 8/2013 Winstanley et al.
D696,582 S 12/2013 Ramsey et al.
D704,555 S 5/2014 Hernandez
8,985,371 B2 3/2015 Zabaleta et al.
D731,311 S 6/2015 Ramsey et al.
D732,402 S 6/2015 Jones et al.
D738,225 S 9/2015 Kim et al.
D738,226 S 9/2015 Kovaleski
D751,338 S 3/2016 Seiders et al.
D751,339 S 3/2016 Seiders et al.
D751,340 S 3/2016 Seiders et al.
9,272,819 B1 3/2016 Zabaleta et al.
D760,092 S 6/2016 Goldman et al.
D767,410 S 9/2016 Pajauskas
9,475,619 B2 10/2016 Procter
9,492,024 B2 * 11/2016 Sorensen ..... A47G 19/2205
9,493,279 B2 11/2016 Mackenzie et al.
D778,734 S 2/2017 Odikor
D786,703 S 5/2017 Chapman et al.
D787,952 S 5/2017 Jacober et al.
9,655,463 B2 5/2017 Madala
D802,362 S 11/2017 Spivey et al.
D803,684 S 11/2017 Seiders et al.
D815,893 S 4/2018 Seiders et al.
10,005,608 B1 6/2018 Jacob
D836,395 S 12/2018 Seiders et al.
D850,291 S 6/2019 Bidzinashvili
10,414,555 B2 9/2019 Steinmann et al.
D867,057 S 11/2019 Spivey et al.
10,486,868 B2 11/2019 Spivey et al.
10,677,516 B2 * 6/2020 Huisman ..... B65D 21/083
10,974,889 B2 * 4/2021 Callinan ..... B65D 81/3886
2003/0136803 A1 7/2003 Kuwano et al.
2003/0222083 A1 12/2003 Pladsbjerg
2005/0127076 A1 6/2005 Law et al.
2007/0095845 A1 5/2007 Auer
2007/0138176 A1 * 6/2007 Gawlick ..... A47J 47/08 220/4.26
2007/0164027 A1 7/2007 Auer
2007/0175931 A1 8/2007 Leoncavallo et al.
2008/0078763 A1 4/2008 Auer
2009/0232947 A1 9/2009 Buisson et al.
2010/0288724 A1 11/2010 Jahn
2011/0220670 A1 9/2011 Poole et al.
2011/0297689 A1 12/2011 Reed et al.
2013/0068765 A1 3/2013 Procter
2013/0126369 A1 5/2013 Gamelli
2015/0191293 A1 7/2015 Forcella
2017/0297785 A1 10/2017 Maruyama et al.
2019/0135502 A1 5/2019 Tsai

FOREIGN PATENT DOCUMENTS

EM 000103262-0001 11/2003
EM 000154299-0002 3/2004
EM 000175039-0001 5/2004
EM 000228184-0007 9/2004
EM 000230990-0009 9/2004
EM 000237060-0001 9/2004
EM 000310180-0005 3/2005
EM 000439369-0001 11/2005
EM 000556055-0001 6/2006
EM 000564240-0002 7/2006
EM 000673348-0005 2/2007
EM 000692223-0004 3/2007
EM 000813878-0001 10/2007
EM 000856315-0003 1/2008
EM 000863105-0001 1/2008
EM 000966098-0001 7/2008
EM 001730847-0002 7/2010
EM 001758970-0001 9/2010
EM 001814138-0002 2/2011
EM 001825175-0001 2/2011
EM 001263628-0001 3/2011
EM 001845280-0001 4/2011
EM 001859356-0001 5/2011
EM 001901588-0003 8/2011
EM 001953605-0003 11/2011

(56) References Cited

FOREIGN PATENT DOCUMENTS

| | | | |
|---|---|---|---|
| EM | 001958539-0001 | | 12/2011 |
| EM | 001959271-0001 | | 12/2011 |
| EM | 001960295-0002 | | 12/2011 |
| EM | 002031997-0004 | | 4/2012 |
| EM | 002036848-0001 | | 5/2012 |
| EM | 002091363-0001 | | 8/2012 |
| EM | 002134718-0005 | | 11/2012 |
| EM | 002157305-0002 | | 12/2012 |
| EM | 002186544-0006 | | 2/2013 |
| EM | 002202093-0001 | | 3/2013 |
| EM | 002221531-0002 | | 4/2013 |
| EM | 002238402-0002 | | 5/2013 |
| EM | 002245621-0001 | | 5/2013 |
| EM | 002286732-0001 | | 8/2013 |
| EM | 002306084-0008 | | 9/2013 |
| EM | 002306183-0001 | | 9/2013 |
| EM | 002326587-0001 | | 10/2013 |
| EM | 001404107-0001 | | 2/2014 |
| EM | 0025289270001 | | 9/2014 |
| EM | 0026034640001 | | 12/2014 |
| EM | 002653469-0002 | | 3/2015 |
| EM | 002659086-0001 | | 3/2015 |
| EM | 002659268-0001 | | 3/2015 |
| EM | 002659300-0001 | | 3/2015 |
| EM | 002711879-0001 | | 6/2015 |
| EM | 002733584-0004 | | 7/2015 |
| EM | 001439202-0004 | | 9/2015 |
| EM | 003056654-0002 | | 4/2016 |
| EM | 003061159-0002 | | 4/2016 |
| EM | 003061258-0003 | | 4/2016 |
| EM | 003526227-0003 | | 12/2016 |
| EM | 003825249-0003 | | 3/2017 |
| FR | 2736620 | A1 | 1/1997 |
| JP | 5651326 | B2 | 1/2015 |
| KR | 200479685 | Y1 | 3/2016 |
| WO | 030087-001 | | 7/1994 |
| WO | 061988-001 | | 10/2002 |
| WO | 067852-005 | | 9/2004 |
| WO | 2007085674 | A1 | 8/2007 |
| WO | 2008078860 | A1 | 7/2008 |
| WO | 081845-008 | | 10/2013 |

* cited by examiner

BEVERAGE CONTAINER ENCLOSURE

CROSS REFERENCE TO RELATED APPLICATIONS

The present application is a continuation of U.S. application Ser. No. 16/440,603, filed on Jun. 13, 2019, which claims priority to U.S. Provisional Application Ser. No. 62/684,638, filed on Jun. 13, 2018, both of which are incorporated by reference herein in their entirety.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present disclosure relates to beverage container enclosures and methods of manufacturing and use therefore, including an enclosure for beverage cans.

2. Description of the Background of the Invention

Beverage containers are frequently packaged in lightweight containers to be convenient for consumers and cost-effective in distribution. Many beverages are distributed in thin, metal cans such as aluminum or tin-plated steel. These metal cans are lightweight and durable, but the containers offer little in the way of thermal insulation to the can contents, efficiently transferring heat directly from a consumer's hand or the surrounding environment to the stored beverage, which can make holding a cold beverage uncomfortably cold for a consumer. Another side-effect of the thermal conductivity issues of metal cans highlighted above is that condensation quickly forms along outer surfaces of cold cans when in an environment having a high temperature differential, and condensation further increases the transfer of environmental heat to the stored beverage. In addition to the issues highlighted above, the thin metal of commercially available beverage cans provide little to no protection against bumps and pierces of the metal can.

External enclosures for beverage containers can be useful to both physically protect and/or thermally insulate beverage cans so as to improve the durability and enjoyment of beverages from those cans. In addition to thermal and protective functionality, a beverage container enclosure can be used as a form of expression, e.g., to convey a message, to identify team affiliation, or to advertise corporate branding.

One conventional beverage can enclosure is the can koozie, which is often a flexible, foam envelope that surrounds and insulates a bottom and the sidewalls of a beverage can. A foam koozie can effectively shield a beverage can from the heat of a consumer's hands and/or the environment, but often leaves a top of the beverage can exposed to radiative and convective heat transfer. Additionally, a koozie provides only limited physical protection to the can and its contents, and leaves the top of the can exposed and vulnerable.

Accordingly, it is recognized that a continued need exists to overcome and improve upon such shortcomings in conventional beverage container enclosures. The inventors of the present disclosure have found a superior solution that better protects the beverage can from physical damage and heat transfer, while offering a more attractive and comfortable exterior and a more enjoyable experience for beverage consumers.

SUMMARY OF THE INVENTION

Various aspects are described in connection with an illustrative implementation of a beverage container enclosure disclosed herein. The various aspects are disclosed in the written specification including the drawings, and claims, and may be combined to form claims for a device, apparatus, system, method of manufacture, and/or use in any way, consistent with the teachings herein, without limitation.

In some embodiments, a container enclosure for removably enclosing a container is provided. The enclosure may include a base component that includes an outer shell having a base wall and a sidewall extending upwardly therefrom, a support ring, and an interior sleeve. The enclosure can further include a cap component that includes a lower annular wall and a gasket. The gasket may be disposed within a second cavity defined by the cap, and the gasket may include an aperture that is aligned with an opening of the cap component. The lower wall of the cap can be configured to be inserted into the first cavity of the base component and the cap component may be configured to be removably attached to the base component. The support ring can be disposed around an upper end of the interior sleeve and configured to removably couple the interior sleeve to the outer shell. The interior sleeve may be configured to receive a beverage container.

In some embodiments, the first cavity can have a larger volume than the second cavity. The sleeve sidewall of the interior sleeve may define a circular cross-section. The interior sleeve can be configured to be rotated within the interior cavity. The interior sleeve and the outer shell of the base component may comprise different materials. The interior sleeve can be disposed entirely within the base component.

In some embodiments, the interior sleeve includes a plurality of locking features evenly and radially spaced along the upper end. The plurality of locking feature may further include a ramped surface and a notch. The base component may include a first gap between at least a portion of an exterior wall of the interior sleeve and an interior wall of the outer shell. The base component may include a second gap between a lower surface of the interior sleeve and a lower surface of the outer shell. The gasket can be a disc-shaped gasket having a gasket ring seal, a first gasket mouth seal, and a second gasket mouth seal.

In some embodiments, a container enclosure for removably enclosing a container is provided. The enclosure may include a base component and a cap component configured to be removably coupled to the base component. The base component further includes an outer shell having a base wall and a sidewall extending upwardly therefrom, a support ring positioned at a top end of the base component and coupled to the outer shell, and an interior sleeve configured to be removably inserted within an interior cavity of the base component. The interior sleeve can include an upper end, the upper end having a plurality of locking features extending from an upper surface thereof. Further, the cap component includes an opening and a closure configured to transition between an open position and a closed position to open and close the opening, respectively. A gasket can be disposed within a cap cavity formed by the cap component.

In some embodiments, the interior sleeve may further comprise a lower end that is spaced apart from the base wall of the base component. Both the upper end and the lower end of the interior sleeve may be spaced apart from the outer shell of the base component. The interior sleeve can further comprise a plurality of locking features that include a ramped surface and a notch, the plurality of locking features being evenly spaced apart from each other. The interior sleeve may be configured to receive and maintain a beverage container. Further, the interior sleeve can be configured to rotate with the base component. In some embodiments, the support ring can be configured to couple the interior sleeve to the outer shell of the base component. The interior sleeve may be formed of a less rigid material than the material of the outer shell of the base component.

In some embodiments, a container enclosure for removably enclosing a container is provided. The container may include a base component having a support ring disposed at an upper end of an interior sleeve within an interior cavity within an outer shell of the base component. The support ring can be configured to removably couple the interior sleeve to the outer shell of the base component. A cap component may be configured to be removably secured to the base component. The interior sleeve can include an upper end, a lower end, and a sleeve wall having an exterior surface and an interior surface. The upper end may include a plurality of locking features evenly spaced apart from each other. The exterior surface of the sleeve wall can be spaced apart from an interior side of the outer shell, and the interior surface of the sleeve wall may be configured to fit around a beverage container. Further, the cap component includes an open bottom defined by a lower annular wall. The lower annular wall can be configured to fit within the base component. A cap cavity may extend between a top surface and the open bottom, the cap cavity having a smaller volume than the volume of the interior cavity. An opening and a closure can be configured to transition between an open position and a closed position to open and close the opening, respectively. Still further, a gasket may be coupled to the top surface within the cap cavity. The gasket can have an aperture that is configured to be aligned with the opening of the cap component. The container enclosure may be configured to conceal the beverage container.

In another aspect, a container enclosure for removably enclosing a container is disclosed. The container enclosure includes a base component and a cap component configured to be removably coupled to the base component. The base component includes an outer shell having a base wall and a cylindrical sidewall extending upwardly therefrom, and an interior sleeve configured to be inserted within the outer shell. The cap component includes an opening and a sliding tab configured to transition between a rearward position and a forward position to open and close the opening, respectively.

In related aspects, the base component may further include a support ring positioned between the outer shell and the interior sleeve, and the interior sleeve may be seated on the support ring. The base component may also include a plurality of locking features that include a ramped surface, a notch, and an end wall, and the cap component may also include a lower annular wall that includes a plurality of tabs. In such embodiments, the tabs may be configured to interact with the locking features to secure the cap component to the base component. In one example, the interior sleeve of the base component includes the locking tabs.

In some examples, the base component may include a spacing between at least a portion of an exterior wall of the interior sleeve and an interior wall of the outer shell. Further, the base component may also include a second spacing between a lower surface of the interior sleeve and an interior surface of the base wall. The cap component may further include a gasket having a gasket ring seal, a first gasket mouth seal, and a second gasket mouth seal.

In still another aspect, a container for removably enclosing a container is provided. In this example, the container includes a base component and a cap component configured to be removably coupled to the base component. The base component includes an outer shell having a base wall and a cylindrical sidewall extending upwardly therefrom, and an interior sleeve configured to be inserted within the outer shell. The cap component includes a gasket, an opening, and a sliding tab configured to transition between a rearward position and forward position to open and close the opening, respectively. Further, the base component and the cap component define an interior cavity sized and shaped to at least partially enclose the container when coupled together, and the gasket includes a mouth seal configured to surround and provide a seal around a mouth of the container enclosed within the container enclosure.

In some embodiments, the interior sleeve further includes a plurality of locking features that comprise a ramped surface, a notch, and an end wall. The cap component also includes a lower annular wall with a plurality of tabs. In such embodiments, the tabs are configured to interact with the locking features to secure the cap component to the base component. The base component may also include a spacing between at least a portion of an exterior wall of the interior sleeve and an interior wall of the outer shell. Further, the base component may include a second spacing between a lower surface of the interior sleeve and an interior surface of the base wall. In some aspects, the base component may further include a spring assembly connected to the lower surface of the interior sleeve, and the gasket may include a gasket ring seal and a second mouth seal. The gasket ring seal may be configured to surround the opening of the cap component and provide a seal between the gasket and a top surface of the container, and the second mouth seal may be configured to provide a second seal around the mouth of the container.

In yet another aspect, a container enclosure for removably enclosing a container is disclosed. The container includes a base component and a cap component configured to be removably coupled to the base component. The base component includes an outer shell having a base wall and a cylindrical sidewall extending upwardly therefrom, and an interior sleeve configured to be inserted within the outer shell. The cap component includes a cap shell, a gasket, a ring assembly, and a sliding tab. The interior shell is positioned within and partially surrounded by the outer shell, and includes a plurality of locking features. The cap shell includes an opening and a depression configured to surround the sliding tab. The sliding tab is configured to transition between a rearward position and forward position to open and close the opening, respectively. Further, the ring assembly includes a plurality of tabs configured to interact with the locking features to secure the cap component to the base component, and the gasket is positioned within and attached to an interior wall of the cap shell, and includes a first gasket seal and a second gasket seal.

In a further aspect, a beverage container enclosure is disclosed. The enclosure includes a base component and a cap component configured to attach to the base component, enclosing a beverage container such as a metal can. The base component includes a relatively more rigid external shell and a relatively less rigid internal thermal insulating sleeve. The cap components include a relatively more rigid external cap shell, a relatively less rigid internal insert or gasket, and a sliding tab. The insert includes rings that form a seal with the top of the beverage container so the container contents do not leak out between the beverage container and the enclosure. The cap shell and insert both include mouths, through which the container contents can exit the beverage container through the enclosure. The sliding tab covers the mouth of the cap component.

The beverage container enclosures disclosed herein comprise uniquely configured and constructed base and cap components. In some examples, the base component is a rigid material formed into a rigid exterior base shell that is generally cylindrical with an open top and a closed bottom surface, which is dimensioned and configured to hold a beverage can. The base component may be formed of metal such as stainless steel or aluminum.

In one aspect, the base portion may additionally incorporate an internal sleeve component that comprises a thermally insulating material formed into a generally cylindrical shape with an open top and a closed bottom, matching the interior shape and lining the interior of the rigid exterior shell of the base component. The sleeve aids in securing the beverage can in the base component and thermally insulating the beverage can from outside temperatures. In one aspect, the sleeve may be constructed of foam, such as a closed cell neoprene foam. In one aspect, the sleeve may be removable from the rigid material of the base portion. In a separate aspect, the sleeve may be secured to the rigid material of the base portion with an adhesive. In some examples, a vacuum-sealed double wall enclosure provides insulation for a can. In some aspects, the cap component is rotatably secured via a locking tab with the base component.

In some examples, the cap component is dimensioned and configured to removably connect to the base component, enclosing a beverage container between the cap and base. The cap component may include a relatively more rigid exterior cap shell in the shape of an inverted cup (generally cylindrical with an open bottom and a generally closed, generally flat upper surface). In one aspect, the cap includes securing hooks configured to secure the cap component to the base component. In another aspect, the cap component may include indicators guiding a user where to apply pressure to disengage the securing hooks from the base component. In another aspect, the cap component may include structural ribs to increase the durability of the cap component. The cap includes an opening through the upper surface, the opening being generally positioned to align with the usual location of a can opening in a beverage can, enabling a user to consume a beverage from an enclosed beverage can through the cap opening without removing the can from the enclosure. The cap includes a sliding tab that covers and seals the cap mouth, protecting against spilled liquid exiting or external objects entering the beverage container through the cap mouth.

The cap and base components are configured so that they are secured to one another to facilitate and maintain a bias toward the closed position. The cap and base components are further dimensioned and configured to enable a beverage can to be inserted into and removed from the interior of the base when the cap is removed from the base.

In another aspect, the cap portion may include a relatively less rigid insert or gasket to form a seal around the top of a can enclosed in the beverage container enclosure. The gasket includes a gasket mouth that aligns with the cap mouth and the can mouth. In one aspect, one or more gasket hooks extend from the cap sidewall, and are hooked around a gasket edge to support the gasket. In another aspect, one or more cap protrusions extend from the underside of the upper cap surface into one or more gasket divots minimizing relative rotation between the cap shell and the gasket. In one aspect, the gasket portion may include a gasket ring seal providing a seal with the can ring depression inside of the can lip. In another aspect, the gasket portion may additionally or instead include a gasket mouth seal providing a seal around the can mouth depression. In one aspect, the base portion and the cap portion together resemble a beverage can. In another aspect, the sliding tab resembles a pull-tab from a beverage can, giving the entire enclosure a beverage can-like appearance.

Various alternative implementations of the foregoing aspects are disclosed. The foregoing various aspects may be combined in any manner without limitation. The foregoing and other aspects and advantages of the disclosure will appear from the following description. In the description, reference is made to the accompanying drawings, which form a part hereof, and in which there is shown by way of illustration a preferred configuration of the disclosure. Such configuration does not necessarily represent the full scope of the disclosure, however, and reference is made therefore to the claims herein for interpreting the scope of the disclosure.

BRIEF DESCRIPTION OF THE DRAWINGS

The present disclosure will be better understood and features, aspects, and advantages other than those set forth above will become apparent when consideration is given to the following detailed description thereof. Such detailed description makes reference to the following drawings.

Figure 1:
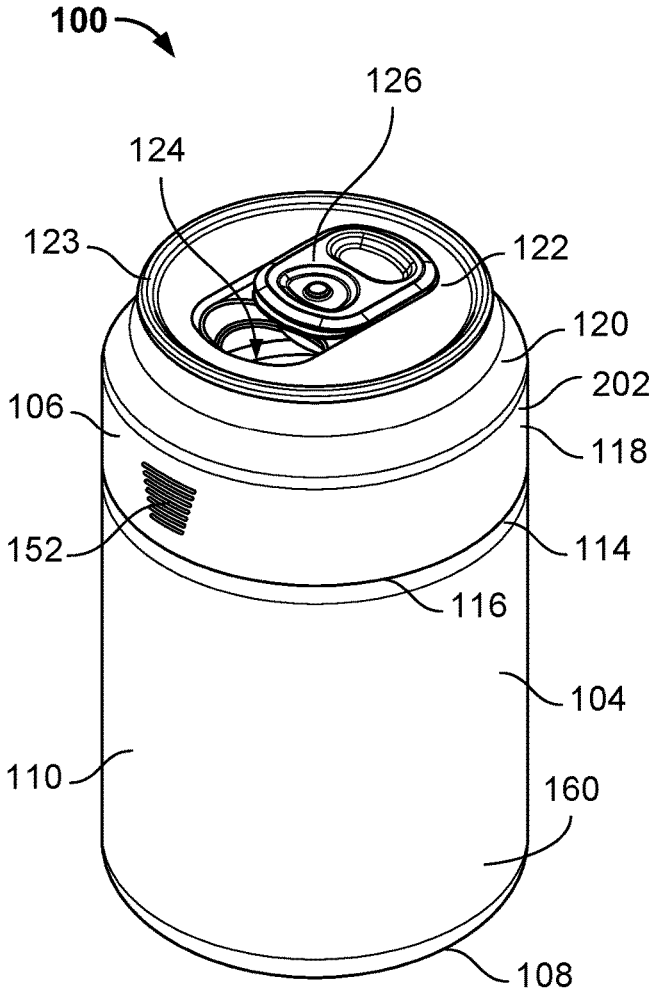
FIG. 1 is a top, right, and front isometric view of a first embodiment of a beverage container enclosure in an assembled or connected configuration, wherein a sliding tab is in an open position.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DRAWINGS

Certain embodiments of the present disclosure provide a beverage container enclosure that may be configured to enclose a beverage container, such as a can.

The features, aspects and advantages are described below with reference to the drawings, which are intended to illustrate but not to limit the present disclosure. Multiple embodiments are provided within the disclosure. In the drawings, like reference characters denote corresponding features consistently throughout the drawings.

FIGS. 1-23 illustrate various aspects of a container enclosure 100 for a beverage or can 102, according to a first aspect of the present disclosure, and FIGS. 24-46 illustrate various aspect of a container enclosure 400 for a beverage or can 402, according to a second aspect of the present disclosure. It should be understood, however, that the teachings herein are not limited to any particular container or can, and are applicable to enclosures for containers of other products, whether solid or liquid. Further, it is contemplated that certain features of the container enclosure 100 may be incorporated into or with the container enclosure 400 and vice versa.

As illustrated in FIGS. 1-8, the container enclosure 100 comprises a base or base component 104, and a cap or cap component 106, both of which are dimensioned to attach to each other to enclose the beverage container or can 102 therewithin, as well as detach from each other to insert or remove the beverage container or can 102 from the container enclosure 100. For example, as will be further discussed herein, the base component 104 and the cap component 106 may be coupled and decoupled together by way of a snap fit, interference fit, threading, or another type of fit.

Figure 2:
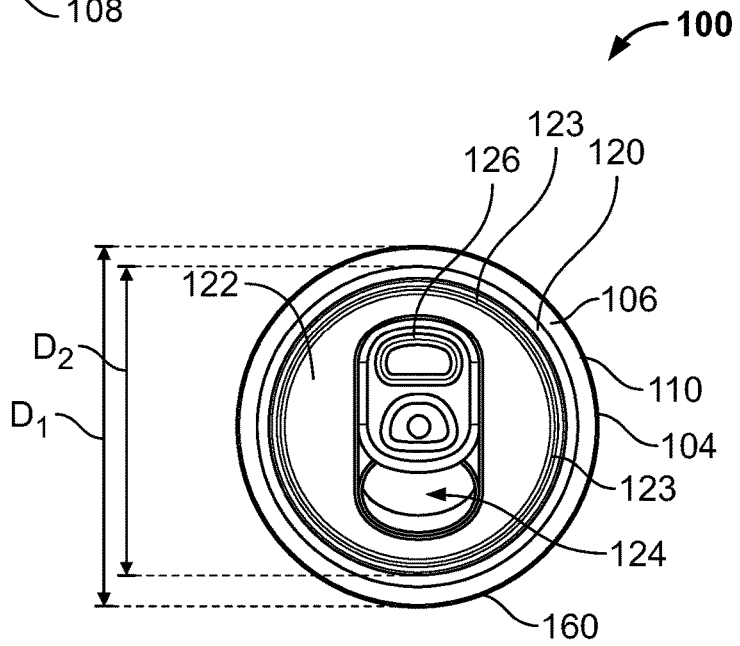
FIG. 2 is a top plan view of the beverage container enclosure of FIG. 1.
Figure 3:
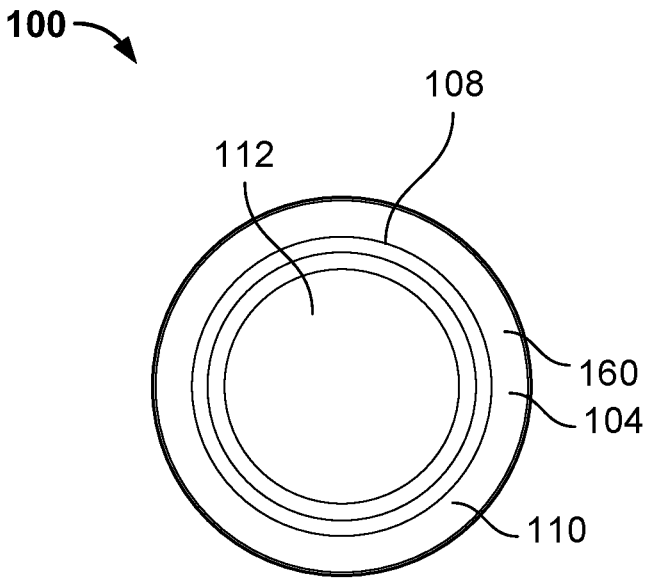
FIG. 3 is a bottom plan view of the beverage container enclosure of FIG. 1.

With continued reference to FIGS. 1-8, the container enclosure 100 may have a shape or configuration that generally mimics a can. As best shown in FIG. 3, the base component 104 may have a generally cylindrical shape and may be rotationally symmetric. As such, in the illustrated embodiment, an isometric view of the base component 104 may depict any of a front isometric view, a rear isometric view, a left isometric view, or a right isometric view, as all such views would be identical. In other embodiments, the base component 104 may not be symmetric, and may include a handle, finger grips, or other externally visible features.

Figure 4:
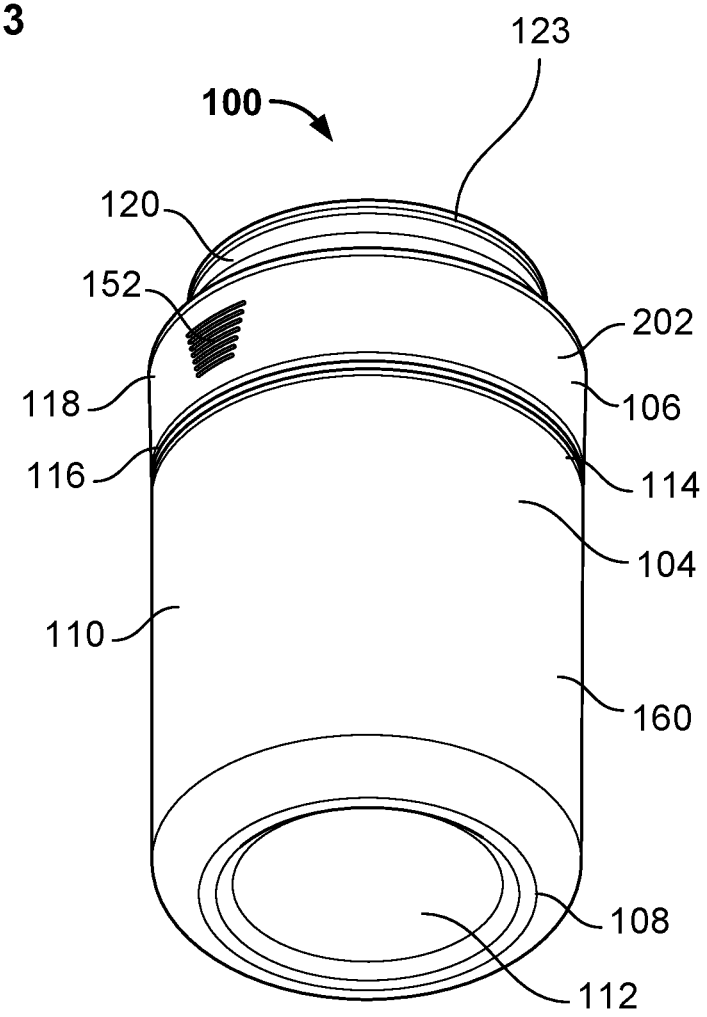
FIG. 4 is a bottom, right, and front isometric view of the beverage container enclosure of FIG. 1.
Figure 5:
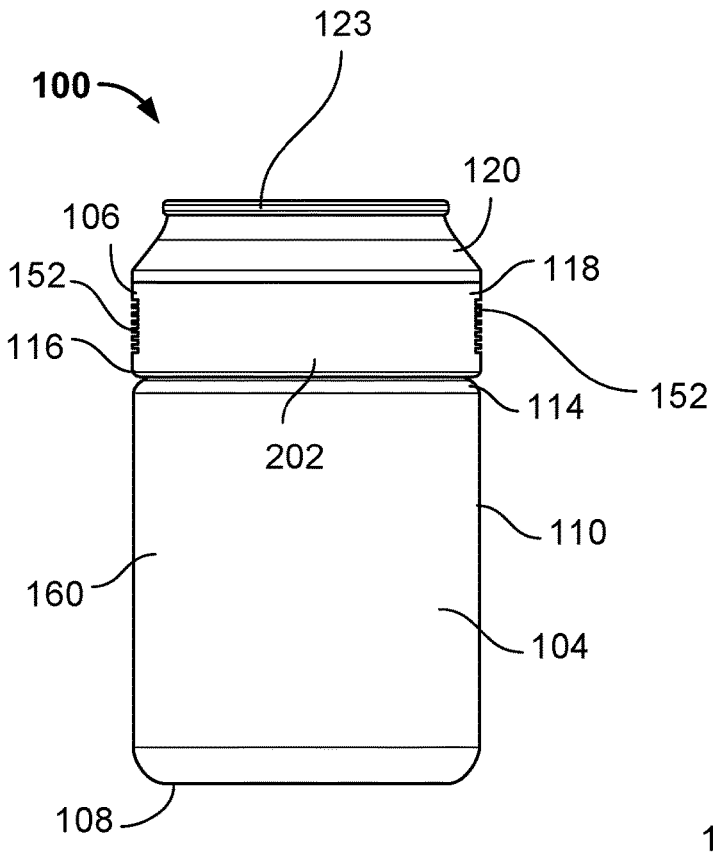
FIG. 5 is a left side elevational view of the beverage container enclosure of FIG. 1.
Figure 6:
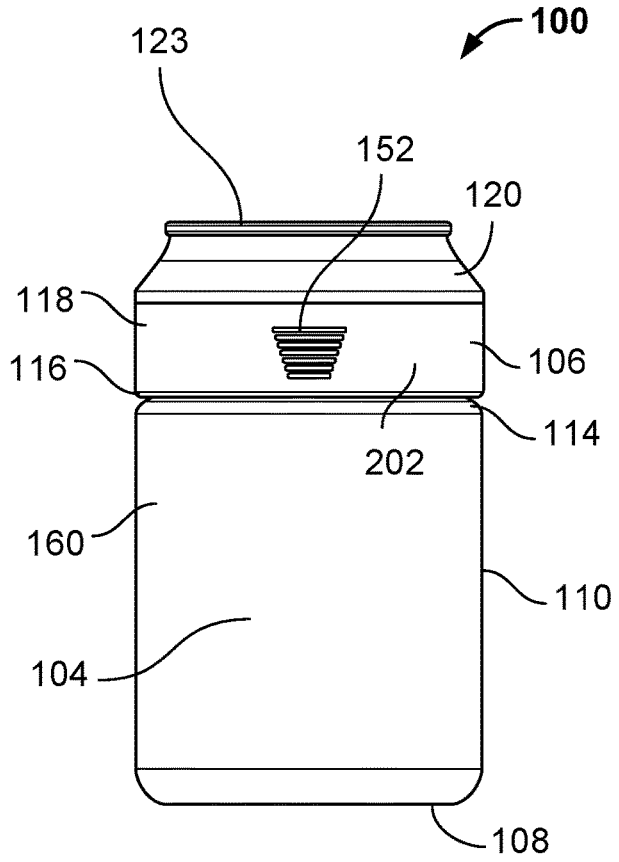
FIG. 6 is a front elevational view of the beverage container enclosure of FIG. 1.
Figure 7:
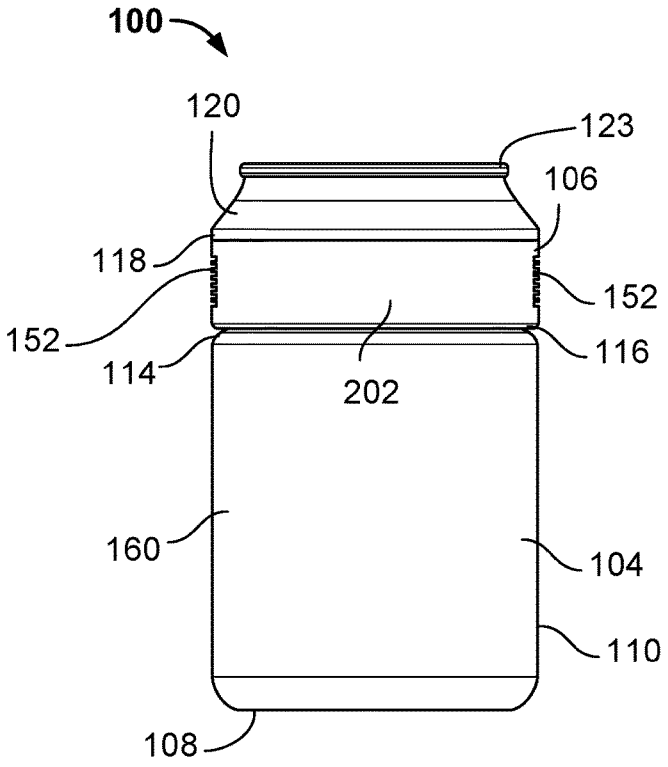
FIG. 7 is a right side elevational view of the beverage container enclosure of FIG. 1.
Figure 8:
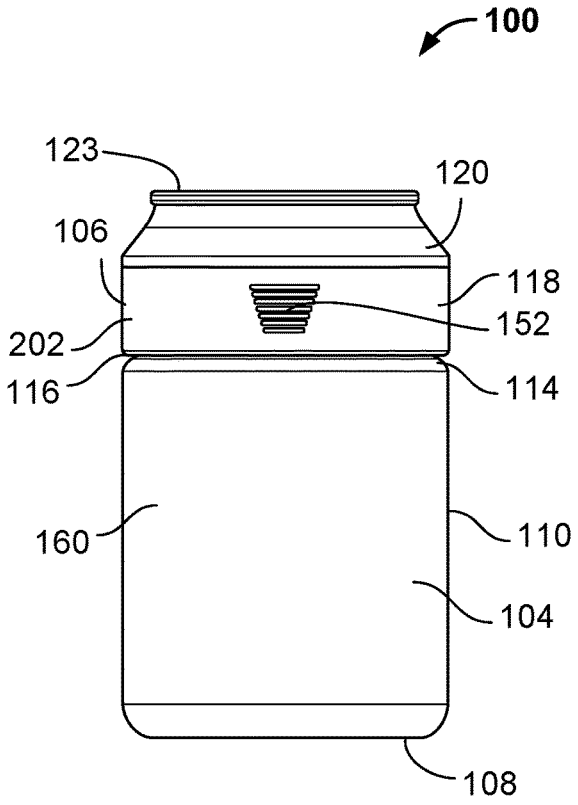
FIG. 8 is a rear elevational view of the beverage container enclosure of FIG. 1.

Referencing FIGS. 3 and 4, the base component 104 may have a circular base 108 with a cylindrical base sidewall 110 extending upwardly therefrom. The circular base 108 may also include a concave, elevated (as viewed from beneath), or depressed surface 112 centrally disposed on a bottom side thereof (see FIGS. 3 and 4). The depressed surface 112 may provide increased stability to the container enclosure 100 when the container enclosure is placed on uneven ground and, even further, the depressed surface 112 may reduce the potential of heat transfer or potential condensation damage to a surface beneath the container enclosure 100.

The base sidewall 110 extends generally straight upward or perpendicular from the circular base 108 to a shoulder 114. In some embodiments, the base sidewall 110 may taper near a top region thereof and, as shown in FIGS. 5-8, the shoulder 114 of the base component 104 may taper inwardly. In other embodiments, the base sidewall 110 may extend straight upward to provide a seamless transition between the base component 104 and the cap component 106. Similarly, the base sidewall 110 may taper near a bottom region thereof and, as best shown in FIGS. 5-8, the circular base 108 may taper inwardly. In other embodiments, the base sidewall 110 may extend straight downward to the circular base 108.

Further, in this embodiment, the base sidewall 110 may have a diameter D1 (see FIG. 2) that is relatively the same therethroughout. However, as will be discussed herein in connection to the container enclosure 400, the base sidewall 110 may also include regions with recessed surfaces or grooves and/or regions with projections or ribs. In such embodiments, the diameter D1 of the base sidewall 110 may be variable or may have areas of varying diameter between the circular base 108 and the shoulder 114.

The base component 104 may be pressed, rolled, or molded from a metal. In some embodiments, the base component 104 may comprise a 304 stainless steel or 18/8 stainless steel material. In other embodiments, the base component 104 may comprise an aluminum, a copper, a zinc, a titanium, or magnesium material, or combinations thereof. The base component 104 may also be constructed or formed from a natural material, such as a rubber, wood, bamboo, or stone, or a crafted material, such as a ceramic, glass, or pottery material. In further embodiments, the base component 104 may be constructed or formed from a synthetic material, such as a synthetic rubber, a plastic, or a carbon fiber. It should be understood that the materials listed above are merely representative and non-limiting. The base component 104 may also be constructed from alternative materials. The base component 104 may be formed of a single unitary piece of material, or in alternative embodiments, the base component 104 may comprise multiple materials or multiple separate pieces joined together.

As briefly discussed above, the cap component 106 is configured to attach and detach from the base component 104. As such, when in an assembled configuration such as that shown in FIGS. 1-8, the cap component 106 fits over and around a top of the base component 104 to enclose a beverage container (e.g., the beverage container 102) within the container enclosure 100. Further, as will be further discussed herein, the container enclosure 100 may protect the beverage container 102 from a temperature change, puncture, loss of carbonation, and/or spills by providing thermal insulation, cushion, and a durable exterior when assembled.

As best shown in FIGS. 1 and 2, the cap component 106 may have a generally cylindrical shape and, more particularly, the cap component 106 may have a circular base 116 (see FIGS. 5-8), with a cylindrical sidewall 118 extending upwardly therefrom. The sidewall 118 extends generally straight upward or perpendicular form the circular base 116 to a tapered neck 120 that angles or tapers inwardly toward a top surface 122 that is surrounded by an annular ridge 123. With reference to FIGS. 5-8, the sidewall 118 may also taper inward near a bottom end thereof, or in alternative embodiments, the sidewall 118 may extend straight downward and may connect or contact an upper surface of the base sidewall 110 to provide a seamless transition between the base component 104 and the cap component 106.

With particular reference to FIG. 2, the cap component 106 may have a first diameter relatively equal to the diameter D1 and a second diameter D2. In particular, the first diameter D1 may be a diameter of the sidewall 118, which may be relatively equal or the same between the circular base 116 and the tapered neck 120, and the second diameter D2 may be a diameter of the top surface 122, which may be smaller than the first diameter D1. Further, in this embodiment, the tapered neck 120 provides a transition between the sidewall 118 having the first diameter D1 and the second diameter D2.

The cap component 106 may also include an opening or mouth 124 that may transition between an open configuration (e.g., see FIGS. 1, 2, and 16A) and a closed position (e.g., see FIG. 16B) using a sliding tab 126, which may slide between a forward position (e.g., see FIG. 16B) to close the opening 124 and a rearward position (e.g., see FIGS. 1, 2, and 16A) to open the opening 124. As such, when the opening 124 is in an open position and the sliding tab 126 is in a rearward position, a user may drink from a beverage within the beverage container or can 102 housed or enclosed within the container enclosure 100 through a mouth 128 of the beverage container 102 without removing the beverage container 102 from the container enclosure 100. In addition, when the opening 124 is in a closed position and the sliding tab 126 is in a forward position, the sliding tab 126 may provide a first seal that seals an interior cavity 150 (see FIG. 10) of the container enclosure 100 from the outside, exterior environment. In this manner, as will be further discussed herein, the container enclosure 100 (and the sliding tab 126 thereof) provides a first seal that protects the beverage container 102 from a temperature change, puncture, loss of carbonation, and/or spillage.

With continued reference to FIGS. 1, 4, and 5-8, the cap component 106 may also include one or more ribs or external indicators 152, which may assist a user with attaching and detaching the cap component 106 from the base component 104, as will be further discussed herein.

The cap component 106 may be molded, pressed, or sewn from an open or closed-cell foam. In this illustrated embodiment, the cap component 106 is molded from Acrylonitrile Butadiene Styrene (ABS). In other embodiments, the cap component 106 may be constructed or formed from natural materials, e.g., wood, bamboo, stone, crafted materials, e.g., pressboard or glass, or other synthetic material, e.g., rubber, plastic, nylon, silicon, polycarbonate, polyvinyl chloride (PVC), polylactic acid (PLA), or other thermoplastics. It should be understood that the aforementioned materials are merely representative and non-limiting. The cap component 106 may be constructed from other materials or a combination of elements or a combination of materials. For example, in some embodiment, the tapered neck 120, the sidewall 118, and/or the top surface 122, may be molded as separate pieces and/or individual materials, and subsequently joined to form the cap component 106. In alternative embodiments, the cap component 106 is molded as a single, unitary piece.

Figure 9:
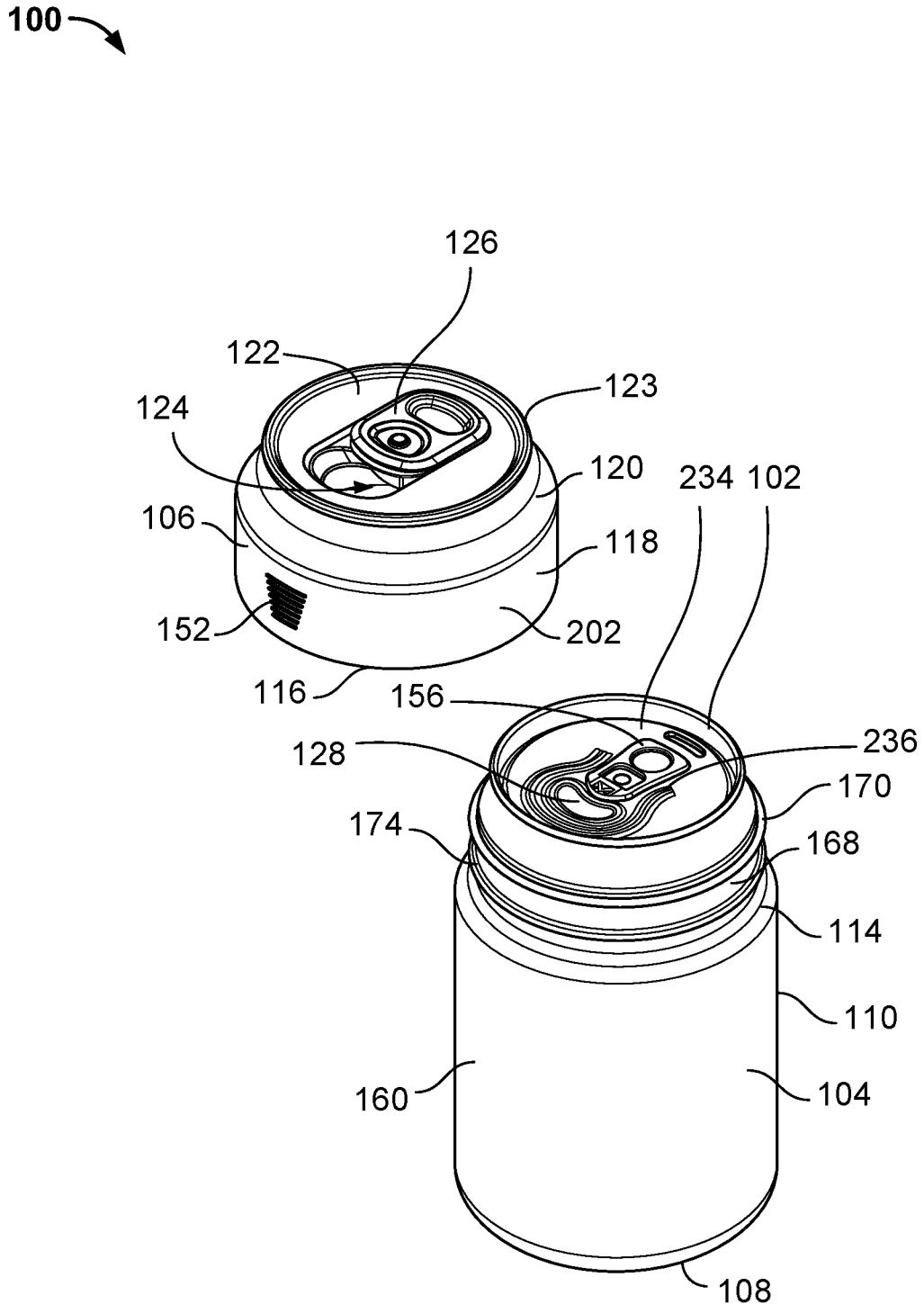
FIG. 9 is a top, right, and front isometric view of the beverage container enclosure of FIG. 1 in a disassembled or detached configuration, having a base component and a cap component, and with a beverage container positioned within the base component of the beverage container enclosure.
Figure 10:
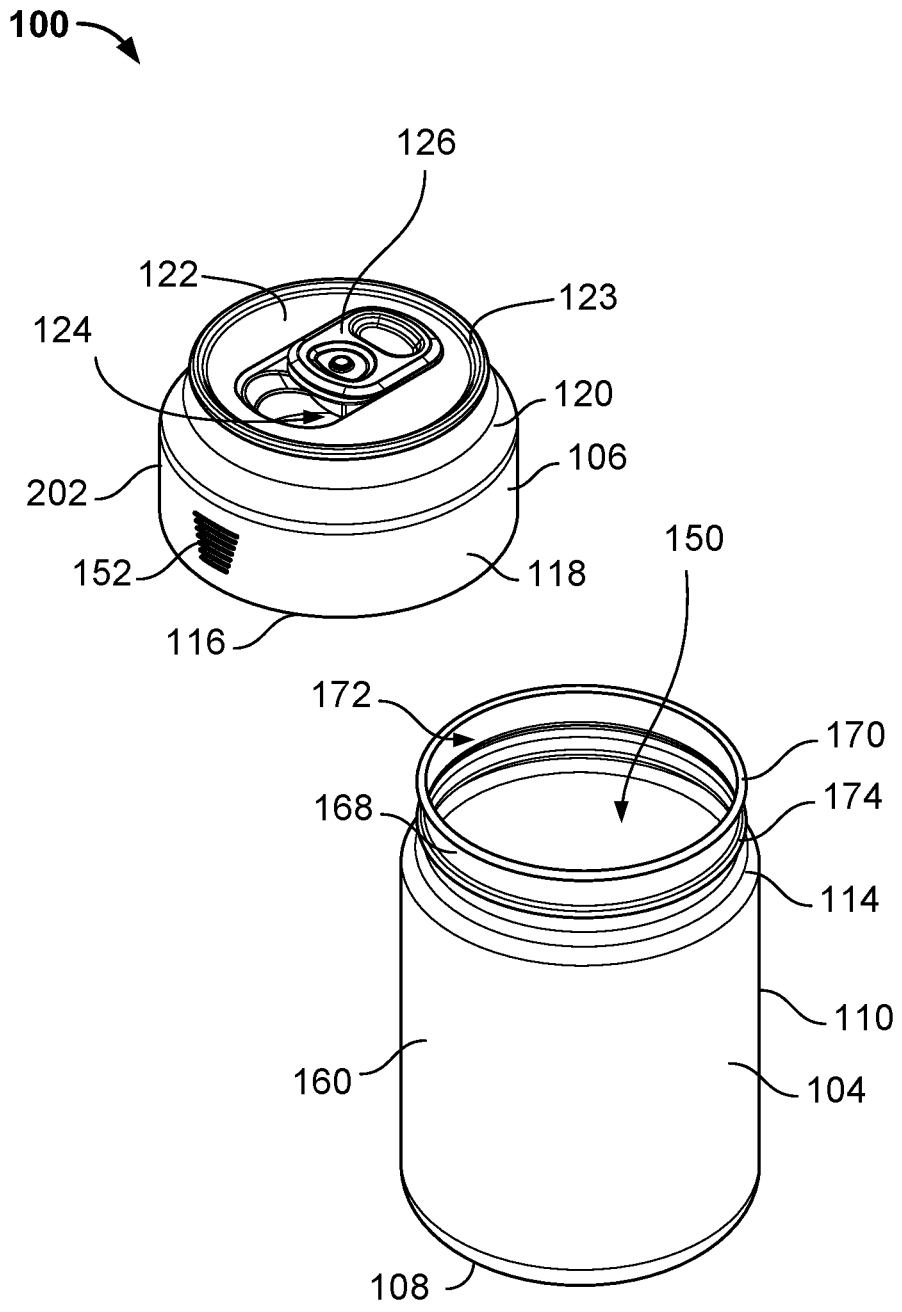
FIG. 10 is a top, right, and front isometric view of the beverage container enclosure of FIG. 9 in a disassembled or detached configuration, wherein the beverage container has been removed from the base component.

Turning to FIGS. 9 and 10, the container enclosure 100 is depicted in a disassembled or detached configuration, both with the beverage container 102 within the base component 104 of the container enclosure 100 (see FIG. 9) and with the beverage container 102 removed from the container enclosure 100 (see FIG. 10). When the base component 104 and the cap component 106 are separated, the interior cavity 150 of the base component 104 (see FIG. 10) and an interior cavity 154 (see FIGS. 17-19) of the cap component 106 are exposed. When exposed, the beverage container 102, e.g., a cold beer can, may be inserted into or removed from the interior cavity 150 of the base component 104. For example, a user may first separate the base component 104 from the cap component 106 to expose the interior cavity 150 (as shown in FIG. 10). Next, a user may insert the beverage container 102 into the interior cavity 150 (as shown in FIG. 9). Then, a user may open the beverage container 102, e.g., by lifting a can tab 156 to puncture and open the mouth 128 of the beverage container 102, and subsequently attach the cap component 106 on a top end of the base component 104 by aligning the mouth 128 of the beverage container 102 with the opening 124 of the cap component 106.

Figure 11:
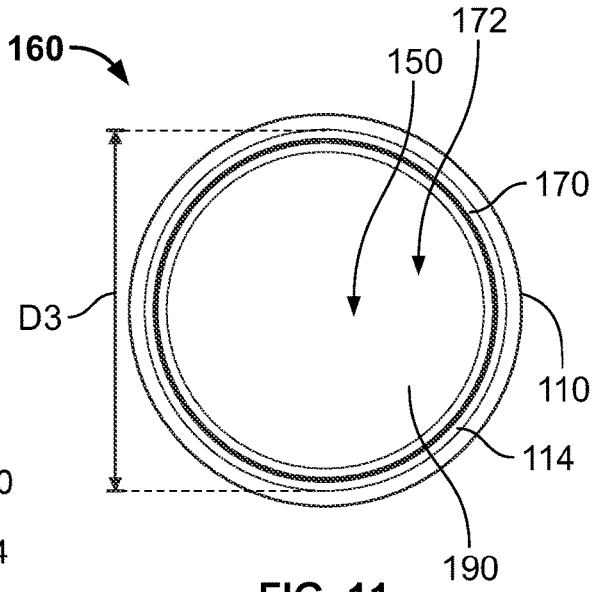
FIG. 11 is a top plan view of a shell of the base component of the beverage container enclosure of FIG. 1.
Figure 12:
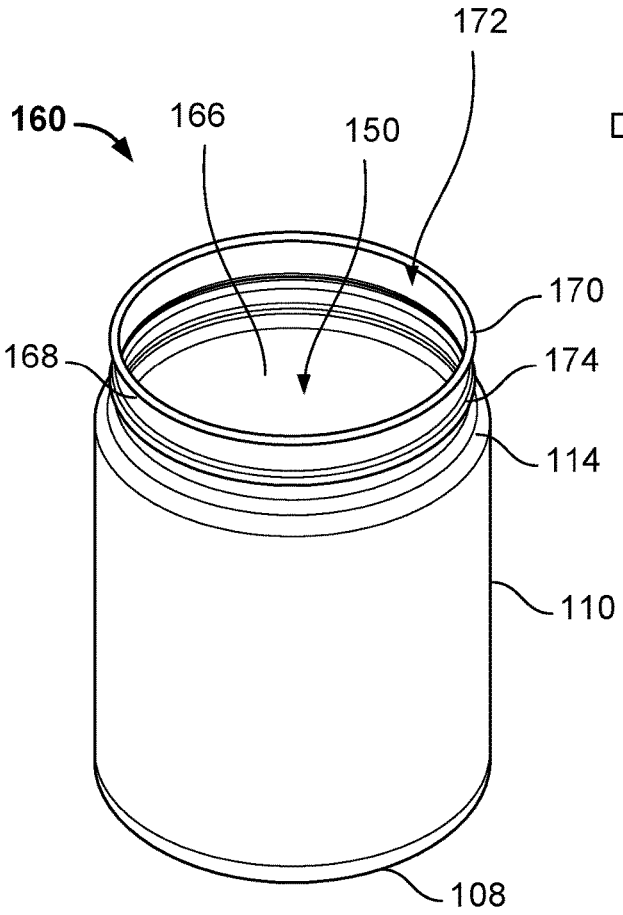
FIG. 12 is a top, right, and front isometric view of the shell of FIG. 11.
Figure 13:
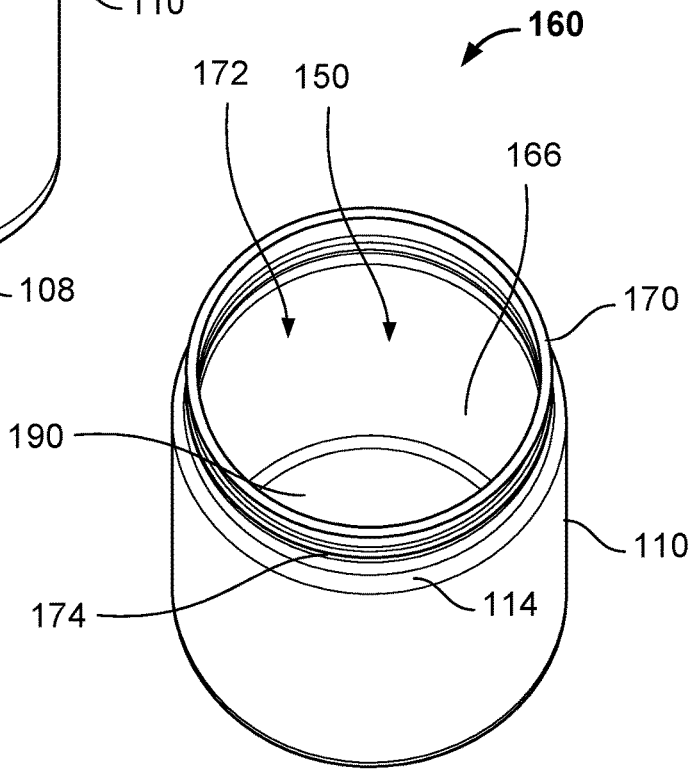
FIG. 13 is a top, right, and front perspective view of the shell of FIG. 11.
Figure 14:
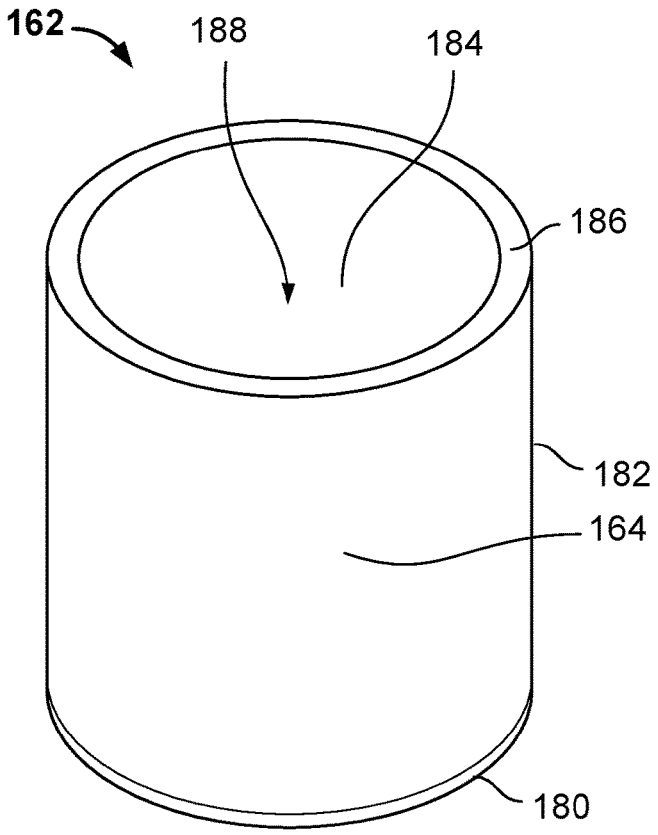
FIG. 14 is a top, right, and front isometric view of an internal sleeve that may be positioned within the shell of the base component.
Figure 15:
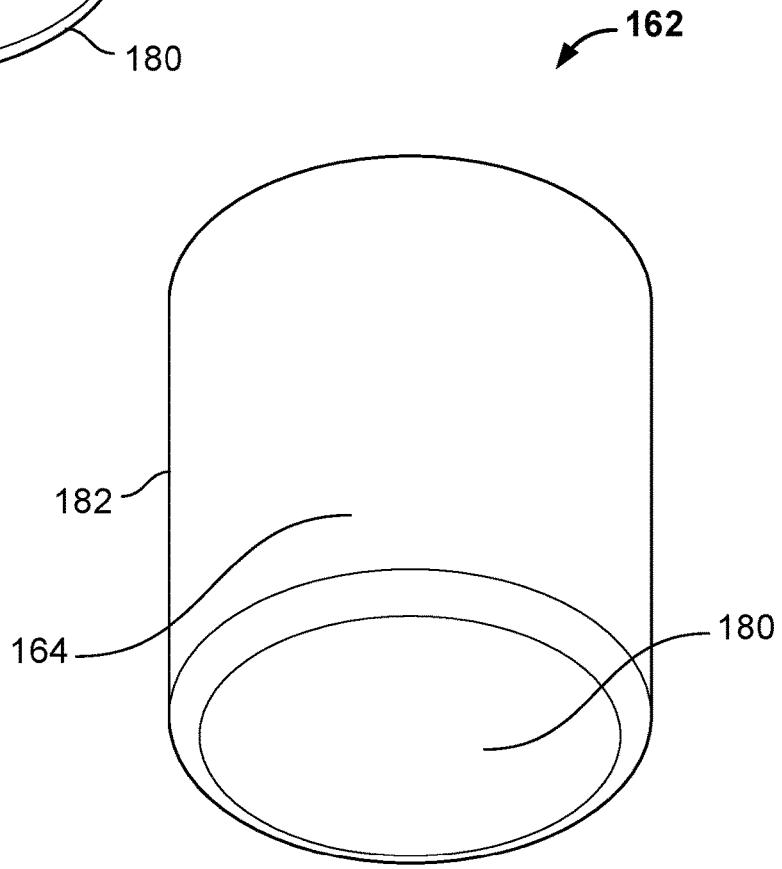
FIG. 15 is a bottom, right, and front isometric view of the internal sleeve of FIG. 14.

With particular reference to FIGS. 11-15, which depicts portions of the base component 104 isolated from other components of the container enclosure 100, the base component 104 may include a shell 160 and an interior sleeve 162. The shell 160, which is depicted in FIGS. 11-13, may be relatively more rigid than the interior sleeve 162, which is depicted in FIGS. 14 and 15. The shell 160 of the base component 104 may also generally define the exterior shape of the base component 104 and, as such, the shell 160 may include the circular base 108, the base sidewall 110, the shoulder 114, etc. Further, the interior sleeve 162 may be configured to be inserted into and sit within the interior cavity 150 of the base component 104 and, in preferred embodiments, an outer surface 164 of the interior sleeve 162 may be dimensioned to be flush with an interior wall 166 of the shell 160. During use, the sleeve 162 may provide friction and pressure to keep or maintain the beverage container 102 within the shell 160, unless the beverage container 102 is intentionally removed or violently jostled.

With reference to FIGS. 9, 10, and 12, the shell 160 may include an annular wall 168 that extends upward from the shoulder 114 to a first base ring or lip 170, which defines an open top 172 that provides access to the interior cavity 150 of the base component 104. Further, with particular reference to FIGS. 11-13, the shell 160 of the base component 104 may also include a second base ring, annular ridge, or rib 174 positioned along the annular wall 168 and between the open top 172 (or the lip 170) of the shell 160 and the shoulder 114. As shown in FIG. 11, the lip 170 and the rib 174 may each have a diameter D3 that are approximately equal, in this embodiment. As will be further discussed herein, having a lip 170 and a rib 174 with approximately equal diameters may enable the cap component 106 to grip or attach to the lip 170 and/or the rib 174. For example, if a shorter, standard dimensioned beverage can is inserted into the base component 104, the cap component 106 may engage the rib 174 and may be attached to the base component 104 thereby. And, if a taller beverage can is inserted within the base component 104, the cap component may engage the lip 170 and may be attached to the base component 104 thereby. In effect, the inclusion of the lip 170 and the rib 174 allows the container enclosure 100 to accommodate and enclose containers of varying heights or sizes. In other words, the interior cavity 150 of the container enclosure 100 may include multiple operational sizes or volumes. It should be understood that the shell 160 may also include additional ribs 174 between the shoulder 114 and the open top 172 to accommodate additional container sizes, as desired.

As discussed above in connection with the base component 104, the shell 160 may be pressed, rolled, or molded from metal. In some embodiments, the shell 160 comprises a 304 stainless steel or 18/8 stainless steel material. In another embodiment, the shell 160 comprises aluminum, copper, zinc, titanium, or magnesium materials. The shell 160 may instead be made of natural materials, e.g., rubber, wood, bamboo, or stone, crafted materials, e.g., ceramic, glass, or pottery, or synthetic materials, e.g., synthetic rubber, plastic, carbon fiber. It should be understood that this material list is merely representative and non-limiting. The shell 160 may be constructed of other materials. The shell 160 may be formed of a single unitary piece of material. The shell 160 may alternatively comprise multiple materials or multiple separate pieces joined together.

FIGS. 14 and 15 depict the thermally insulating sleeve 162. Similar to the shell 160, in this illustrated embodiment, the sleeve 162 may be rotationally symmetric. As such, an isometric view of the sleeve 162 (e.g., FIG. 14) may depict any of a front isometric view, a rear isometric view, a left isometric view, or a right isometric view, as all such views would be identical. In other embodiments, the sleeve 162 may not be symmetric, and may include additional components, such as stitching, adhesive patches or contoured features that assist in keeping the beverage container in a particular alignment within the container enclosure 100.

The sleeve 162 may also comprise a bottom surface 180, and a generally cylindrical sleeve sidewall 182 having the exterior surface or outer surface 164 and an interior surface 184, and extending upward from the bottom surface 180 to an upper lip 186. As shown in FIG. 14, the upper lip 186 defines an opening 188, which provides access to an interior of the sleeve 162 that is defined by the interior wall or surface 184. The sleeve 162 may also have a diameter smaller than the diameter D1 of the base component 104, which enables the sleeve 162 to rest inside the shell 160. In particular embodiments, an outer diameter of the sleeve 162 may be equal to a diameter of the interior wall 166 of the shell 160, and a diameter of the interior wall or surface 184 of the sleeve 162 may be relatively equal to a diameter of the beverage container (e.g., beverage container 102) to be enclosed by the container enclosure 100. In further embodiments, as previously described herein, the shoulder 114 of the base component 104 tapers or narrows to the annular wall 168 and, in such an embodiment, the annular wall 168 may have a diameter smaller than a diameter of the sleeve 162. Therefore, the sleeve 162 may be effectively secured inside the shell 160. In other embodiments, the base component 104 or the shell 160 does not include a tapered shoulder or an annular wall with a diameter smaller than a diameter of the sleeve 162, such that the sleeve 162 may be removed from the shell 160.

In some embodiments, the sleeve 162 is free to rotate within the shell 160 and, in other embodiments, the sleeve 162 may be secured to the shell 160 by injection molding or with an adhesive, for example. In yet another embodiment, the sleeve 162 is a thermally insulating tube, but does not include the bottom surface 180. In such embodiments, the beverage container 102 may rest directly on a bottom base surface 190 (see FIGS. 11 and 13) of the shell 160.

The sleeve sidewall 182 may be a rectangular strip of material with two opposite sides sewn, adhered, bonded, or heat-pressed together, and optionally, further sewn, adhered, bonded, or heat-pressed together with the bottom surface 180. In other embodiments, sleeve 162 may be molded as a unitary piece that does not require any bonding.

The sleeve 162 may also be molded, pressed, or sewn from an open or closed-cell foam. For example, in this illustrated embodiment, the sleeve 162 is made of closed-cell neoprene foam. The sleeve 162 may be alternatively constructed or formed from natural materials, e.g., wood, bamboo, leather, or suede, crafted materials, e.g., fabric, paper, cardboard, or synthetic materials, e.g., rubber, plastic, nylon. The sleeve 162 may also be constructed of a thermally insulating material. It should be understood that this material list, and all material lists anywhere in this application, are merely representative and non-limiting. In other embodiments, the sleeve 162 may be constructed of other materials.

FIGS. 16-19 illustrate the cap component 106, which may fit over and around a top of the base component 104, as previously discussed herein. More particularly, the cap component 106 may include one or more securing hooks 200 (see FIGS. 17-19) that may either grip the lip 170 and/or the rib 174 when the cap component 106 is positioned over the base component 104 and a downward force is applied to the cap component 106. Further, as previously discussed herein, if a shorter, standard dimensioned beverage can is inserted into the base component 104, the securing hooks 200 of the cap component 106 may engage the rib 174 and may be attached to the base component 104 thereby. And, if a taller beverage can is inserted within the base component 104, the securing hooks 200 of the cap component 106 may engage the lip 170 and may be attached to the base component 104 thereby. Once the cap component 106 is attached to the base component 104, the container enclosure 100 may protect the beverage container 102 from a temperature change, puncture, loss of carbonation, and/or spills by providing thermal insulation, cushion, and a durable exterior.

Figure 16A:
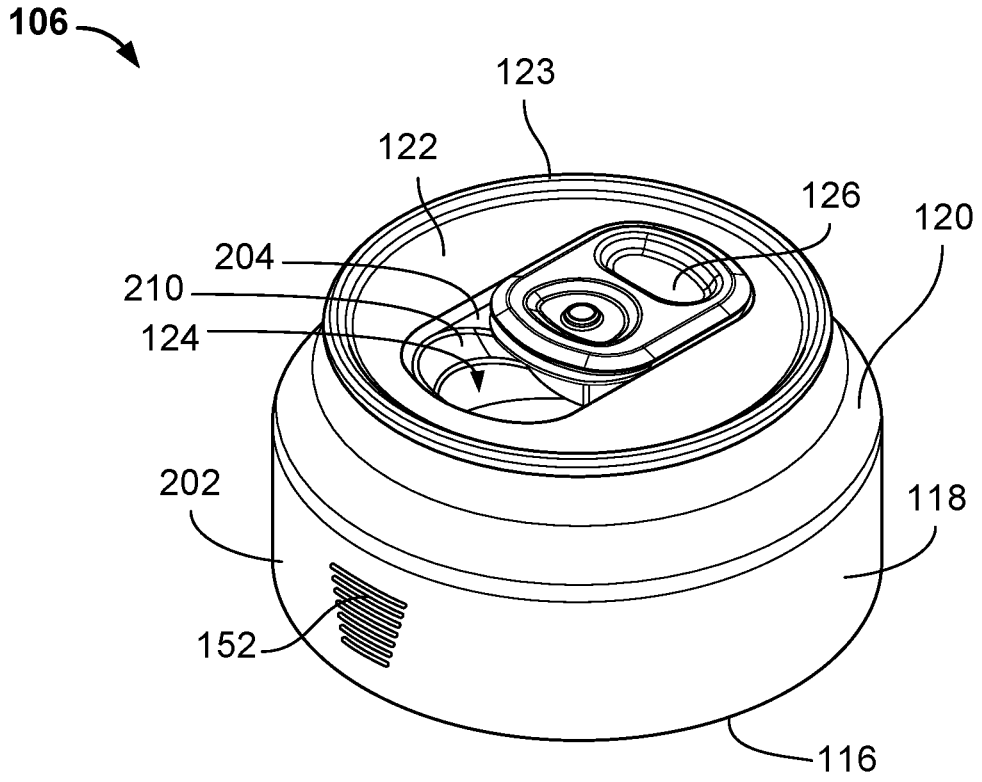
FIG. 16A is a top, right, and front isometric view of the cap of the beverage container enclosure of FIG. 1, wherein the cap is in an open configuration.
Figure 16B:
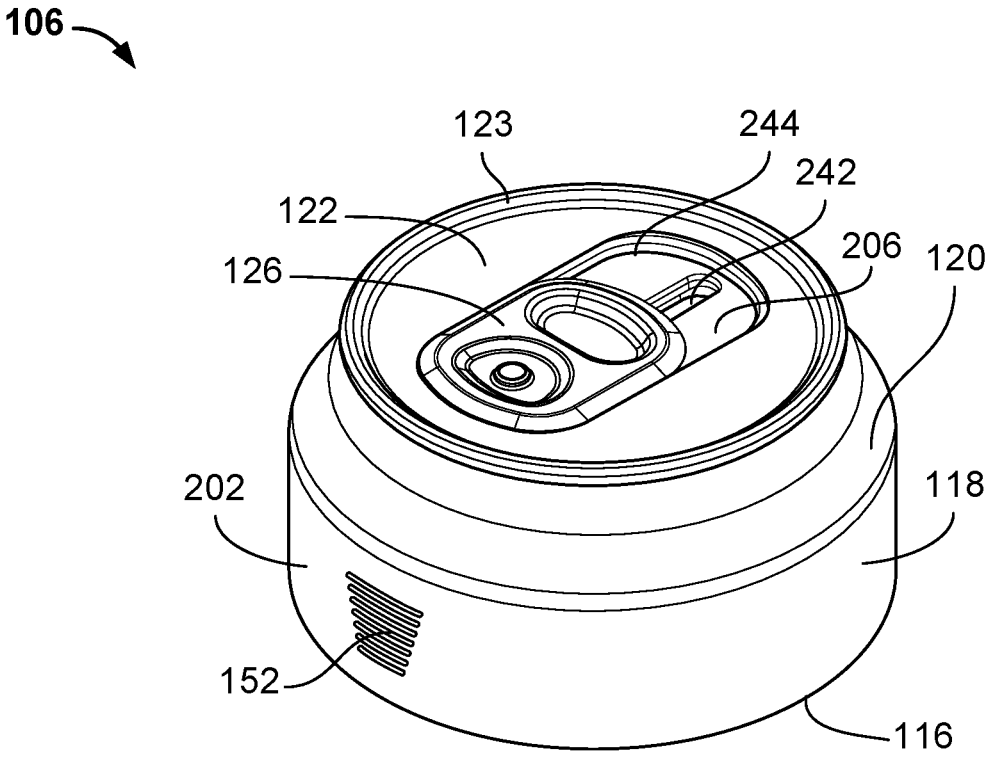
FIG. 16B is a top, right, and front isometric view of the cap of FIG. 16A, wherein the cap is in a closed configuration.
Figure 17:
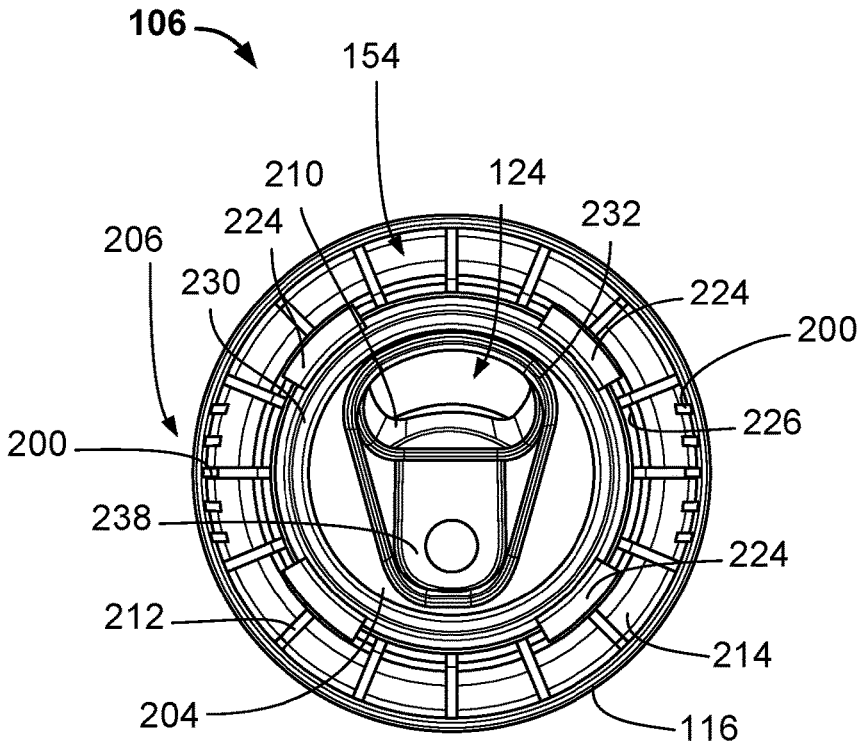
FIG. 17 is a bottom plan view of the cap of FIG. 16A.

With continued reference to FIGS. 16-19, the cap component 106 may include a cap shell 202 and a gasket 204 and, in particular embodiments, the cap shell 202 may be relatively more rigid than the gasket 204. Referencing FIGS. 16A, 16B, and 17, the cap shell 202 may generally define the exterior shape of the cap component 106 and, as such, the cap shell 202 may include the circular base 108, the cylindrical sidewall 118, the tapered neck 120, the top surface 122, and the annular ridge 123. And, as best shown in FIG. 17, the cap shell 202 includes an open bottom 206 that provides access to the interior cavity 154 of the cap component 106, and into which the base component 104 may be inserted.

Turning to FIGS. 17-21, an illustrative embodiment of an internal structure of the cap component 106 (see FIGS. 17-19) and a detailed view of the insert or gasket 204 (FIGS. 20 and 21) that may be attached to the cap shell 202 is shown. In this embodiment, the gasket 204 includes a gasket opening 208, which is defined by vertical, curved, or angled gasket mouth sidewalls 210 that are aligned with the opening 124. As such, the gasket opening 208 and the opening 124 may cooperatively function to direct liquid from the mouth 128 of the beverage container 102, through the gasket mouth or opening 208, and through the opening 124.

Figure 18:
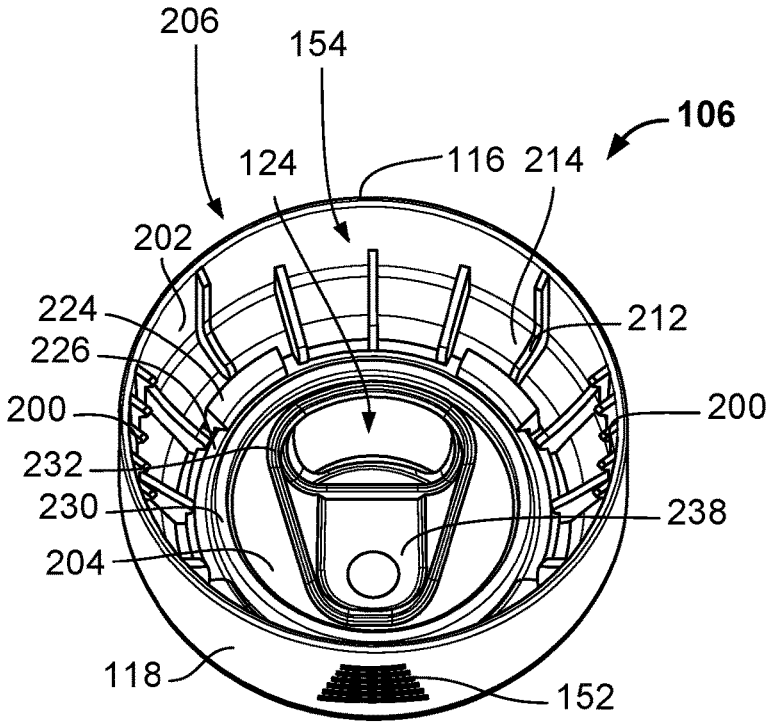
FIG. 18 is a bottom and rear perspective view of the cap of FIG. 16A.
Figure 19:
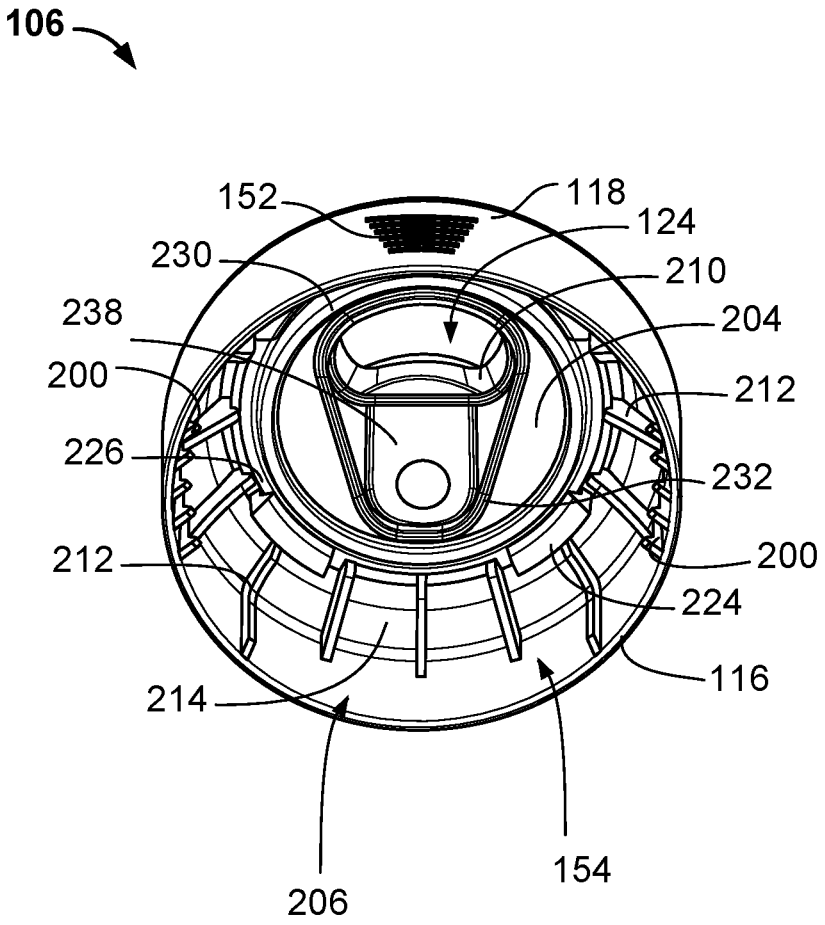
FIG. 19 is a bottom and front perspective view of the cap of FIG. 16A.

As best shown in FIGS. 17-19, the cap component 106 includes a plurality of vertical structural ribs 212 along an interior wall 214, which strengthen the cap shell 202 without significantly increasing a weight or increasing an amount of material used to construct the cap component 106. Some structural ribs 212 may extend all the way from the top surface 122 of the cap component 106 to the open bottom 206 or the circular base 116, while other structural ribs 212 may only extend partially from the top surface 122 to or just past the tapered neck 120. In some embodiments, when a user wishes to remove the cap component 106 from the base component 104, the user may apply simultaneous pressure to the external indicators 152. The shorter structural ribs 212, which are beneath the external indicators 152, then allow the cap component 106 to flex inward at a front and rear point, which causes the left and right sides of the cap component 106 to flex outward. The outward flex of the left and right sides moves the securing hooks 200, which are positioned and attached along right and left sides of the interior wall 214 of the cap component 106, away from the lip 170 and/or the rib 174. As a result, the securing hooks 200 disengage with the lip 170 and/or the rib 174, and enable a user to easily lift and remove the cap component 106 from the base component 104.

Figure 20:
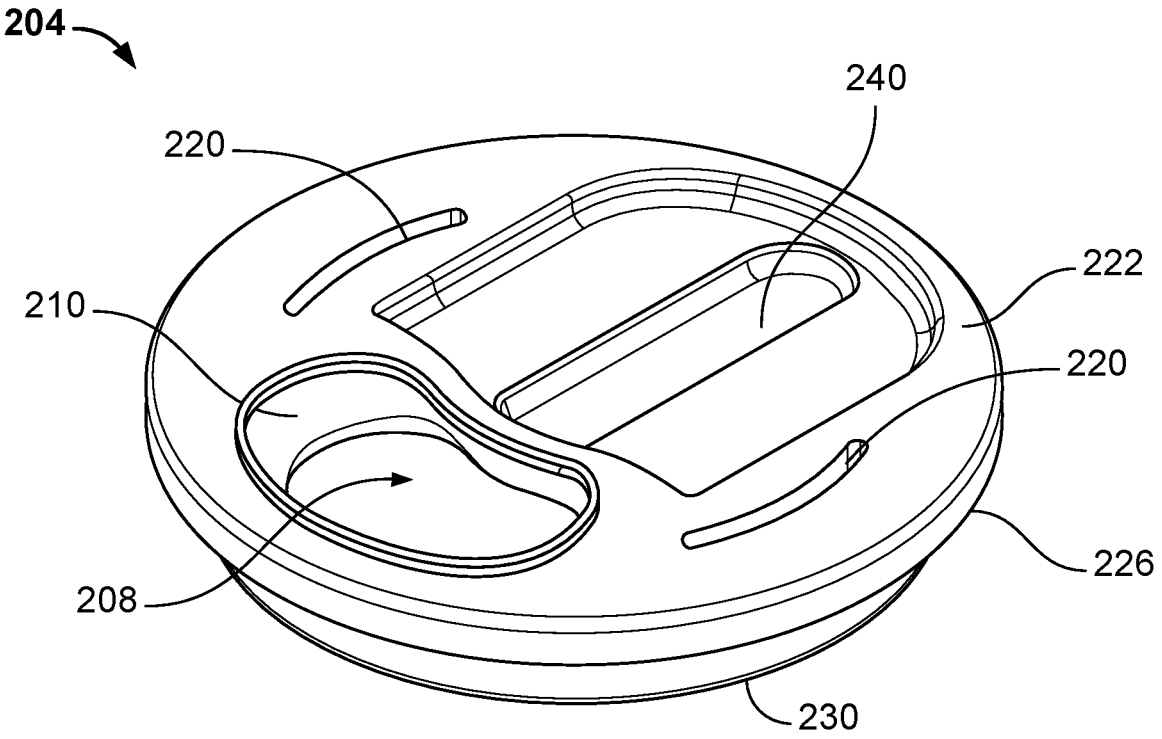
FIG. 20 is a top, right, and front isometric view of an insert or gasket of the beverage container enclosure of FIG. 1.
Figure 21:
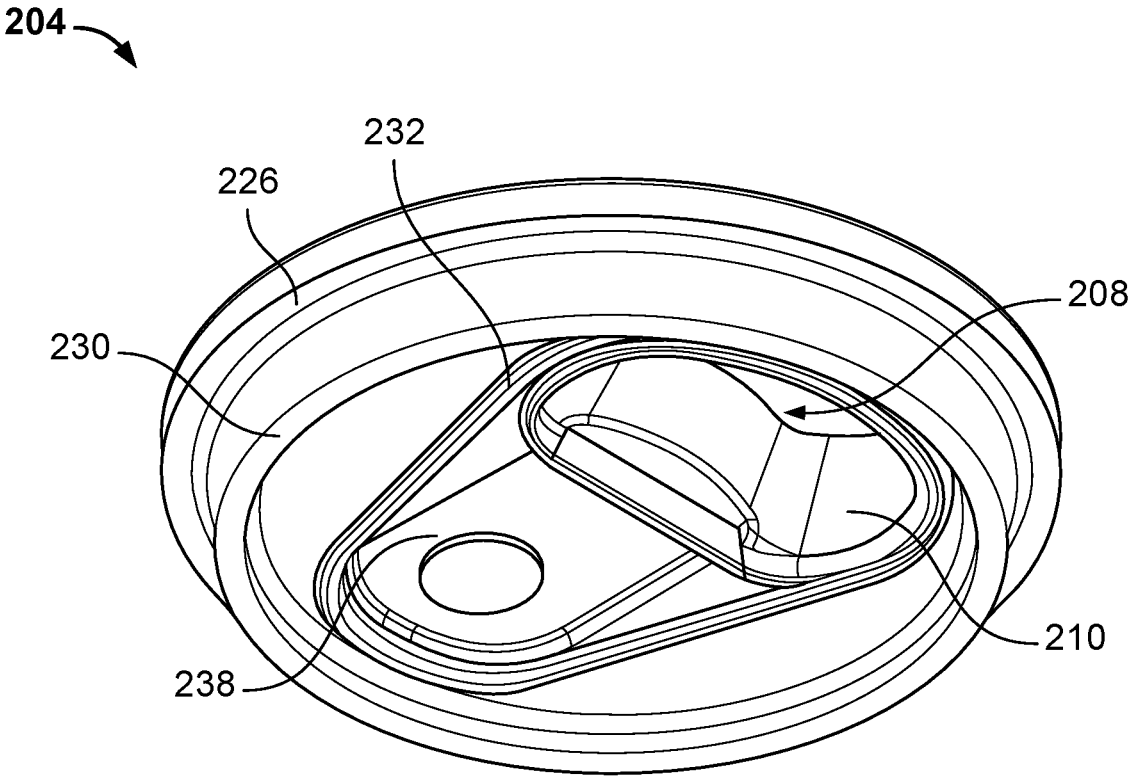
FIG. 21 is a bottom, left, and front isometric view of the insert or gasket of FIG. 20.
Figure 22:
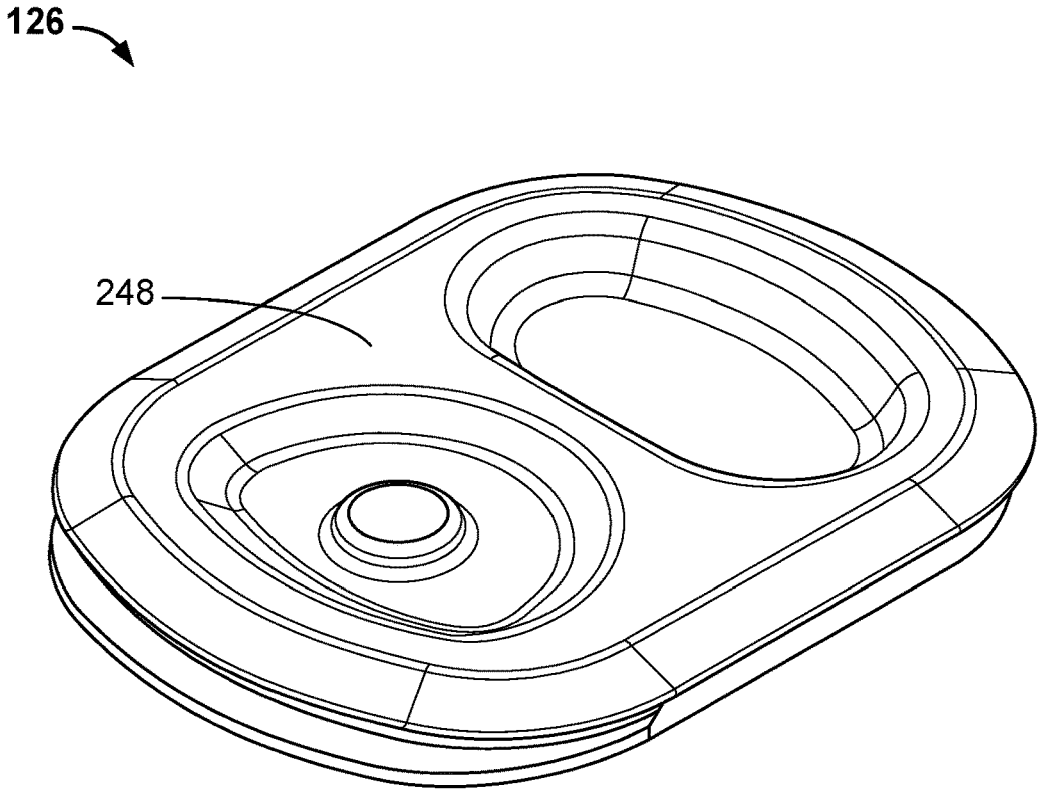
FIG. 22 is a top, right, and front isometric view of the sliding tab of the beverage container enclosure of FIG. 1.

With particular reference to FIGS. 20 and 21, the gasket 204 may include one or more gasket divots 220 that may provide recesses into which cap protrusions (not shown) may fit. In these embodiments, the cap protrusions may extend from an underside of the top surface 122 of the cap shell 202 and engagement of the cap protrusions and the gasket divots 220 may minimize relative rotation between the gasket 204 and the cap shell 202. As shown in FIGS. 20 and 21, the gasket divots 220 may be curved recesses that couple with a pair of complimentarily shaped and dimensioned cap protrusions. In alternative embodiments, any number of cap protrusions and gasket divots could be used, and the cap protrusions and the gasket divots 220 may take any shape or be located on any portion of a top surface 222 of the gasket 204.

The cap shell 202 may also include one or more gasket hooks 224 that extend from the interior wall 214 of the cap shell 202, and hook around a gasket edge 226 to support and couple the gasket 204 to and within the cap shell 202. In particular embodiments, such as that shown in FIGS. 17-19, the gasket hooks 224 may extend inward further than a diameter of the gasket 204 and, as such, may act to secure the gasket 204 inside the cap shell 202, unless intentionally removed or severely jarred. In this embodiment, the cap shell 202 includes four gasket hooks 224 equally spaced around the interior wall 166 of the cap component 106. However, in alternative embodiments, the cap shell 202 may include any number of gasket hooks, ranging from a single continuous ring to a series of bumps. Further, the gasket hooks 224 may be equally spaced, continuously distributed, or unevenly positioned around the interior wall 166 of the cap component 106.

Turning back to FIGS. 17-20, the gasket 204 may have a diameter that is smaller than an internal diameter of the cap shell 202, which enables the gasket 204 to fit inside the cap shell 202. The gasket 204 may also be removed from the cap shell 202 in some embodiments, and in other embodiments, the gasket 204 may be permanently affixed or removably secured to the cap shell 202. With particular reference to FIGS. 17-19 and 21, the gasket 204 may also include a gasket ring seal 230 and a gasket mouth seal 232. As such, if the cap component 106 is properly aligned relative to the beverage container 102 when attached to the base component 104, the gasket ring seal 230 may be inserted into a depression 234 of the beverage container 102 (see FIG. 9) and, thereby, form a boundary or seal with the beverage container 102. Additionally, when aligned, the gasket mouth seal 232 may form a boundary or seal around the mouth 128 and/or a mouth depression 236 of the beverage container 102. In particular embodiments, the gasket mouth seal 232 is dimensioned to form a boundary or seal around an area atop a soda or beer can that includes the mouth 128 and the can tab 156. In some embodiments, a beverage container may not include the mouth depression 234 and, in these embodiments, the gasket ring seal 230 forms an approximate boundary around the mouth 128 and the can tab 156. As shown in FIG. 21, the gasket 204 may also include a depression 238 that is shaped and dimensioned as a cavity to provide clearance for the can tab 156 and reduce upward pressure on the cap component 106 from the can tab 156. The gasket 204 may further include a groove depression 240 that aligns with an underside of a groove 242 on the top surface 122 of the cap shell 202, which enables the contours of the gasket 204 and the cap shell 202 to fit in a snug arrangement.

As previously discussed herein in connection with the cap component 106, the cap shell 202 may be similarly molded, pressed, or sewn from an open or closed-cell foam. In the illustrated embodiment, the cap shell 202 is molded from Acrylonitrile Butadiene Styrene (ABS). The cap shell 202 may also be constructed from natural materials, e.g., wood, bamboo, stone, crafted materials, e.g., pressboard or glass, or other synthetic materials, e.g., rubber, plastic, nylon, silicon, polycarbonate, polyvinyl chloride (PVC), polylactic acid (PLA), or other thermoplastics. It should be understood that this material list is merely representative and non-limiting. The cap shell 202 may be constructed of other materials or a combination of elements or a combination of materials.

In some embodiments, the gasket 204 may be molded, pressed, or constructed. In some embodiments, the gasket 204 is molded from silicon with a flexible 30A Shore hardness. The gasket or insert 204 may also be constructed of natural materials, e.g., rubber, wood, bamboo, plant fiber, sponge, crafted materials, e.g., fabric or pressed paper, or synthetic materials, e.g., synthetic rubber, plastic, nylon, or any other material with sufficient durability and flexibility to function as a gasket. It should be understood that this material list is merely representative and not limiting. The sleeve may be constructed of other materials.

Figure 23:
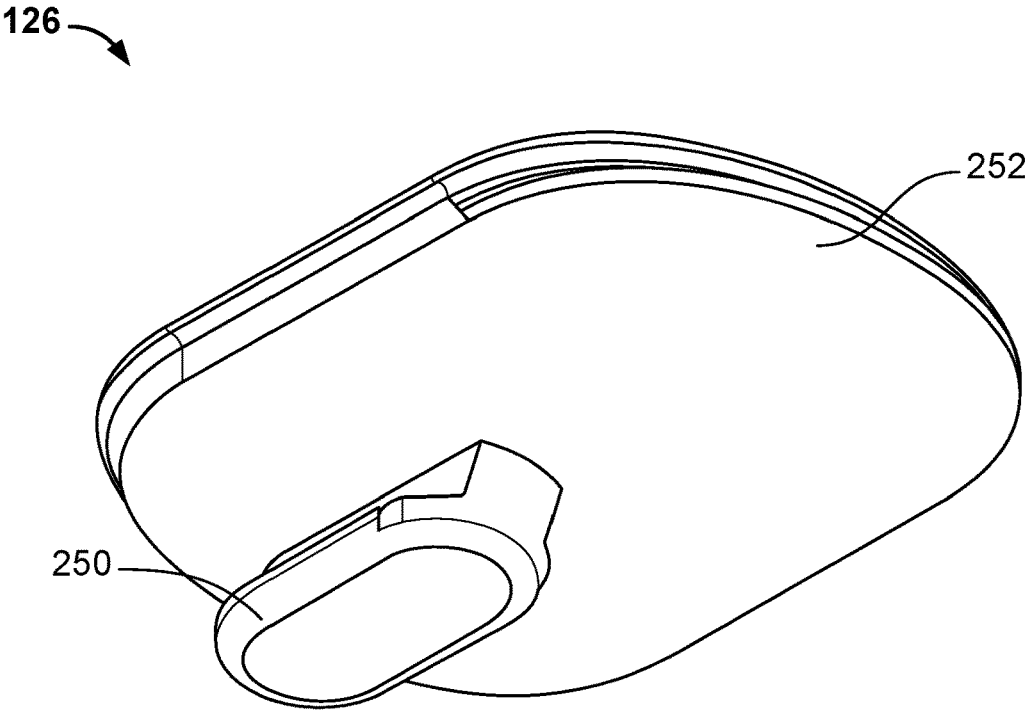
FIG. 23 is a bottom, right, and rear isometric view of the sliding tab of FIG. 22.
Figure 24:
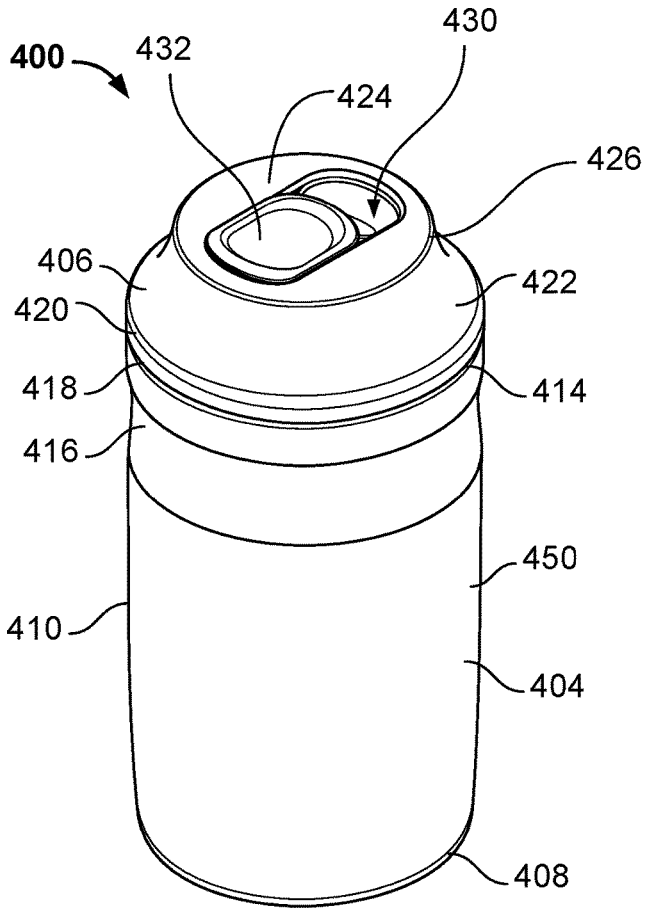
FIG. 24 is a top, left, and rear isometric view of a second embodiment of a beverage container enclosure in an assembled or connected configuration, wherein a sliding tab is in an open position.

Once assembled, the cap component 106 may include a mouth or opening 124 that transitions between an open position (see FIG. 16A), in which the opening 124 is exposed, and a closed position (see FIG. 16B), in which the opening 124 is covered, using a sliding tab 126. More particularly, FIG. 16A depicts the cap component 106 with the sliding tab 126 in the open position, while FIG. 16B depicts the cap component 106 with the sliding tab 126 in the closed position. Further, as noted above, the cap shell 202 may include a groove 242 positioned within a depressed surface 244 on the top surface 122 of the cap shell 202, and the sliding tab 126 may include a tab rail 250 (see FIG. 23) that fits and slides within the groove 242. As best shown in FIG. 23, the tab rail 250 may project from an otherwise flat or planar bottom surface 252, and may have a T-shaped cross-section, which fits within and cooperates with the similarly dimensioned groove 242. In such embodiments, the groove 242 may also have a T-shaped cross-section. In other embodiments, alternate sliding attachment configurations may be employed.

The sliding tab 126 may also be molded to physically resemble a can tab, such as the can tab 156, and may slide forward to a closed position and backward to an open position in the mouth depression 244, which is an approximately rounded rectangular depression around the opening 124 and the sliding tab 126. Although a top 248 of the sliding tab 126 is molded or decorated to resemble the can tab 156 in the present embodiment, the sliding tab 126 may take other decorative or functional shapes without departing from the present disclosure, as will be further discussed herein. However, in preferred embodiments, an outer surface of the sliding tab 126 mimics the outer surface of the depression 244 or vice versa.

During use, the sliding tab 126 can provide a boundary against excessive spills into or out of the beverage can enclosure when in a closed position. In some embodiments, the sliding tab 126 creates a watertight seal over the cap mouth, preventing any external spills. In some embodiments, the bottom surface 252 of the sliding tab 126 may also include a gasket (not shown) configured to create a watertight seal around the mouth 128 of the beverage container 102 when the sliding tab 126 is in the closed position. In some embodiments, sliding tab 126 may also include a tab lock (not shown), which maintains the sliding tab 126 in a closed position unless the tab lock is disengaged. In some embodiments, the sliding tab 126 may also include an opener (not shown), such that when the sliding tab 126 is initially moved from the closed position to the open position, the opener extends through the gasket opening 208, applying pressure to the metal flap over the mouth 128 of the beverage container 102, and automatically opening the beverage container 102 inside the container enclosure 100.

The sliding tab 126 may be molded, pressed, or sewn from an open or closed-cell foam. In one illustrated embodiment, the sliding tab 126 is molded from Acrylonitrile Butadiene Styrene (ABS) in a similar fashion as the cap shell 202. The sliding tab 126 may be constructed from the same material as the cap shell 202 or a different material from cap shell 202. The sliding tab 126 may also be made of natural materials, e.g., wood, bamboo, or stone, crafted materials, e.g., pressboard or glass, or other synthetic materials, e.g., rubber, plastic, nylon, silicon, polycarbonate, polyvinyl chloride (PVC), polylactic acid (PLA), or other thermoplastics. It should be understood that this material list is merely representative and non-limiting. The sliding tab 126 may be constructed of other materials or a combination of materials.

FIGS. 24-46 illustrate various aspects of a container enclosure 400 for a beverage or can 402, according to a second aspect of the present disclosure. As previously mentioned herein, it should be understood that the teachings herein are not limited to any particular container or can, and are applicable to enclosures for containers of other products, whether solid or liquid. Further, as should be apparent from the present disclosure, it is contemplated that certain features of the container enclosure 100 may be incorporated into or with the container enclosure 400 and vice versa.

Figure 25:
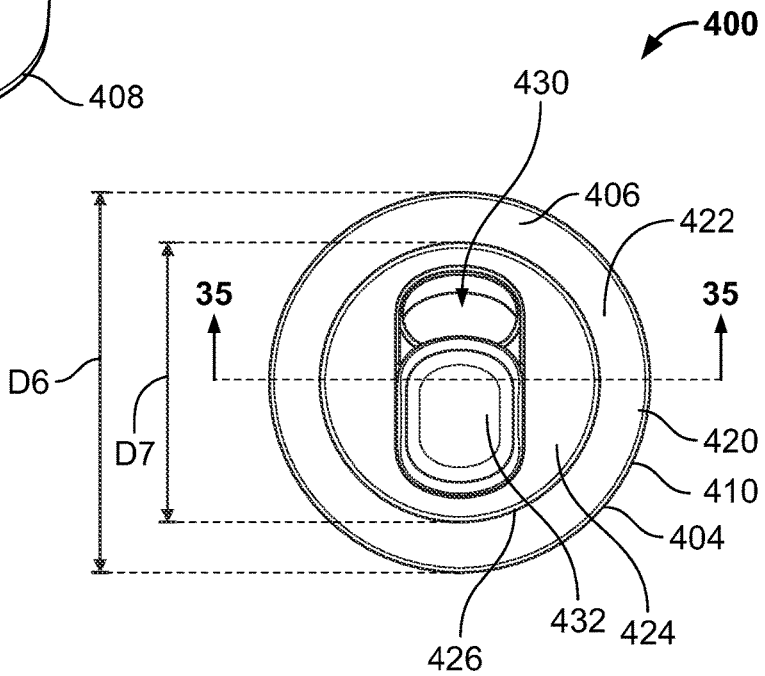
FIG. 25 is a top plan view of the beverage container enclosure of FIG. 24.
Figure 26:
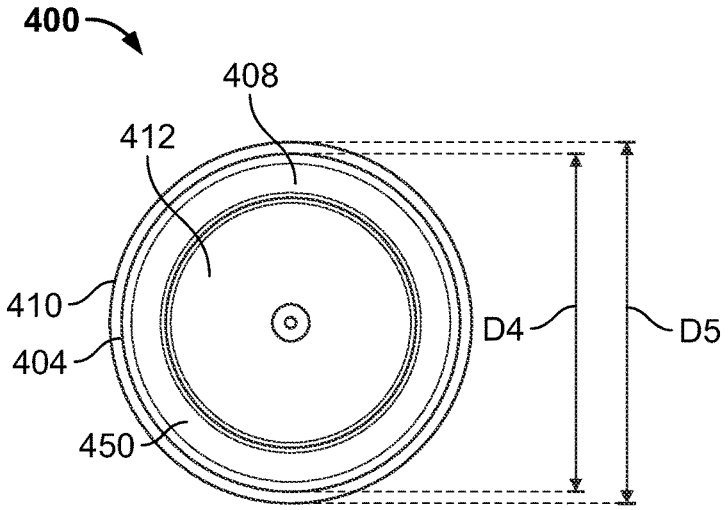
FIG. 26 is a bottom plan view of the beverage container enclosure of FIG. 24.

Referencing now to FIGS. 24-31, the container enclosure 400 may comprise a base or base component 404, and a cap or cap component 406, both of which are dimensioned to attach to each other to enclose the beverage container or can 402 therewithin, as well as detach from each other to insert or remove the beverage container or can 402 from the container enclosure 100. For example, as will be further discussed herein, the base component 404 and the cap component 406 may be coupled and decoupled together by way of a snap fit, interference fit, threading, or another type of fit. With particular reference to FIG. 26, the base component 404 may have a generally cylindrical shape and may be rotationally symmetric. As such, in this illustrated embodiment, an isometric view of the base component 404 may depict any of a front isometric view, a rear isometric view, a left isometric view, or a right isometric view, as all such views would be identical. In other embodiments, the base component 404 may not be symmetric, and may include a handle, finger grips, or other externally visible features.

Figure 27:
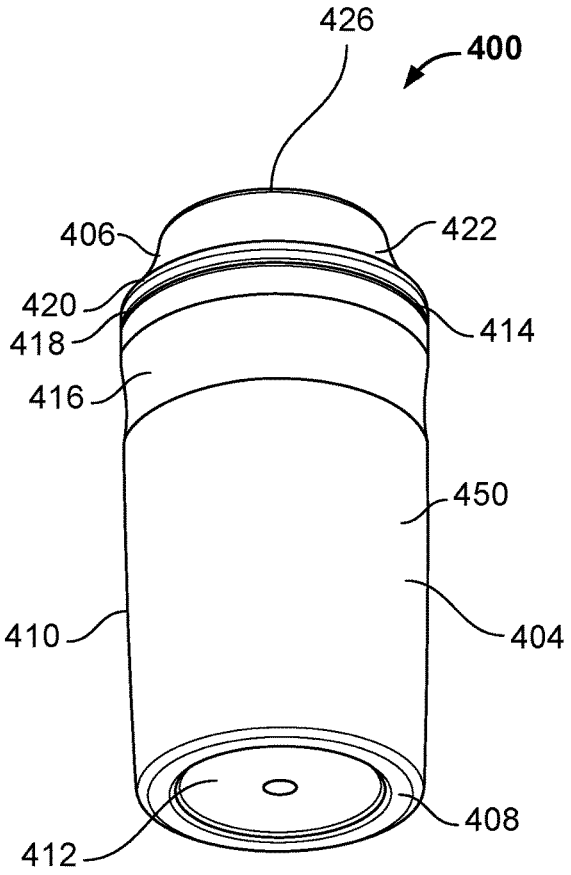
FIG. 27 is a bottom, right, and front isometric view of the beverage container enclosure of FIG. 24.
Figure 28:
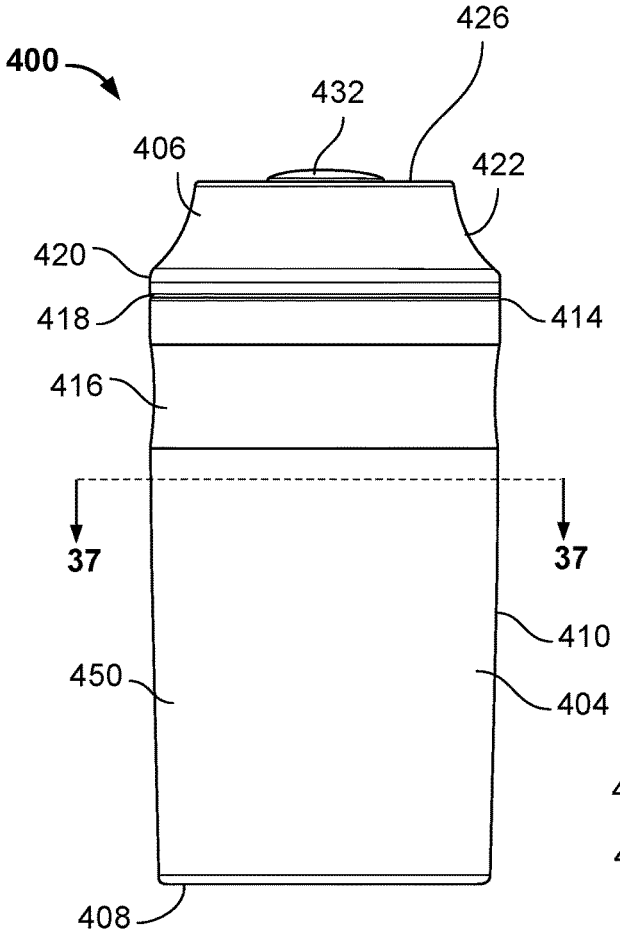
FIG. 28 is a front elevational view of the beverage container enclosure of FIG. 24.
Figure 29:
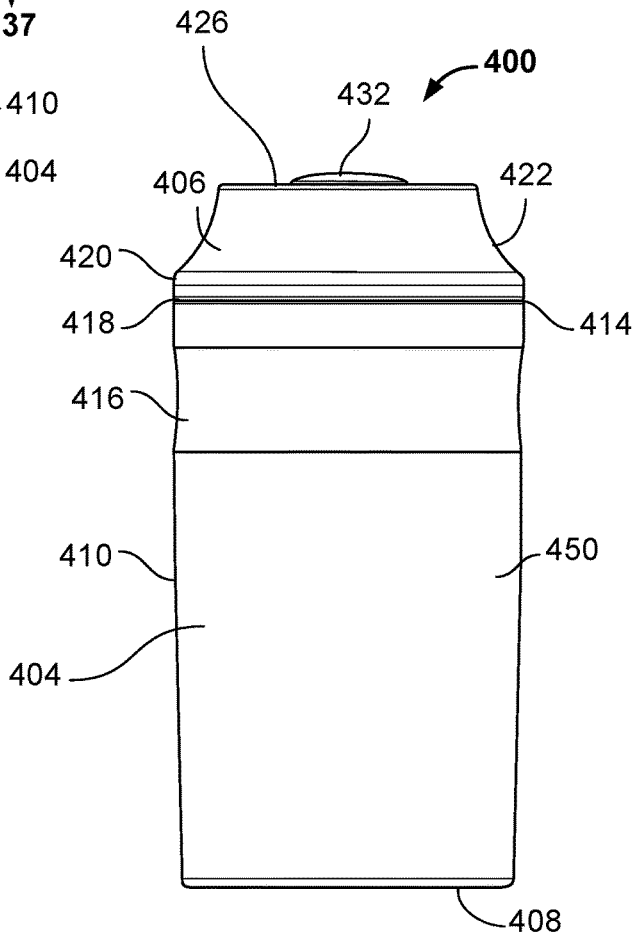
FIG. 29 is a rear elevational view of the beverage container enclosure of FIG. 24.
Figure 30:
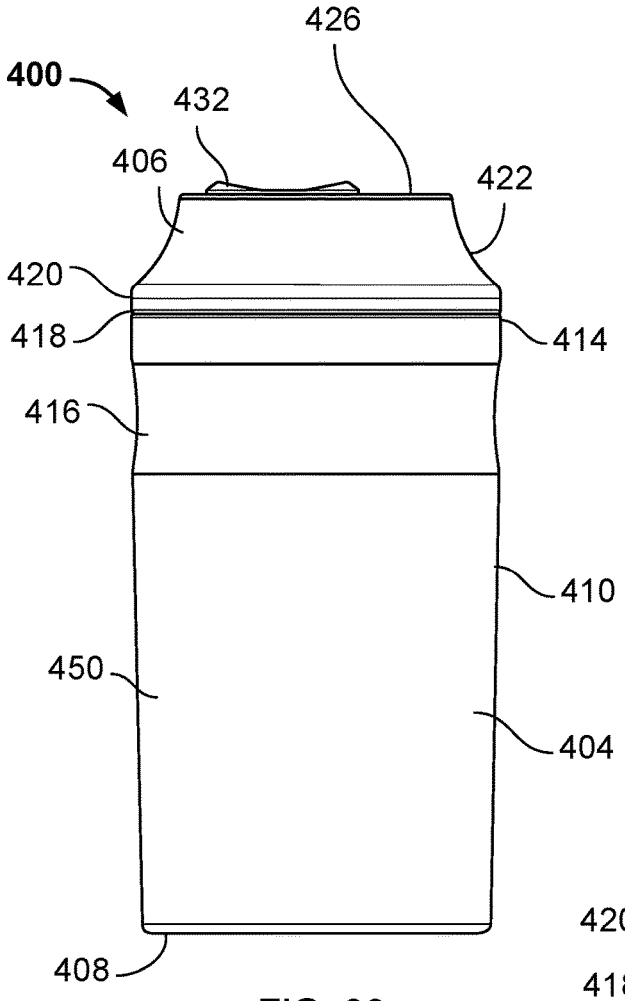
FIG. 30 is a left side elevational view of the beverage container enclosure of FIG. 24.
Figure 31:
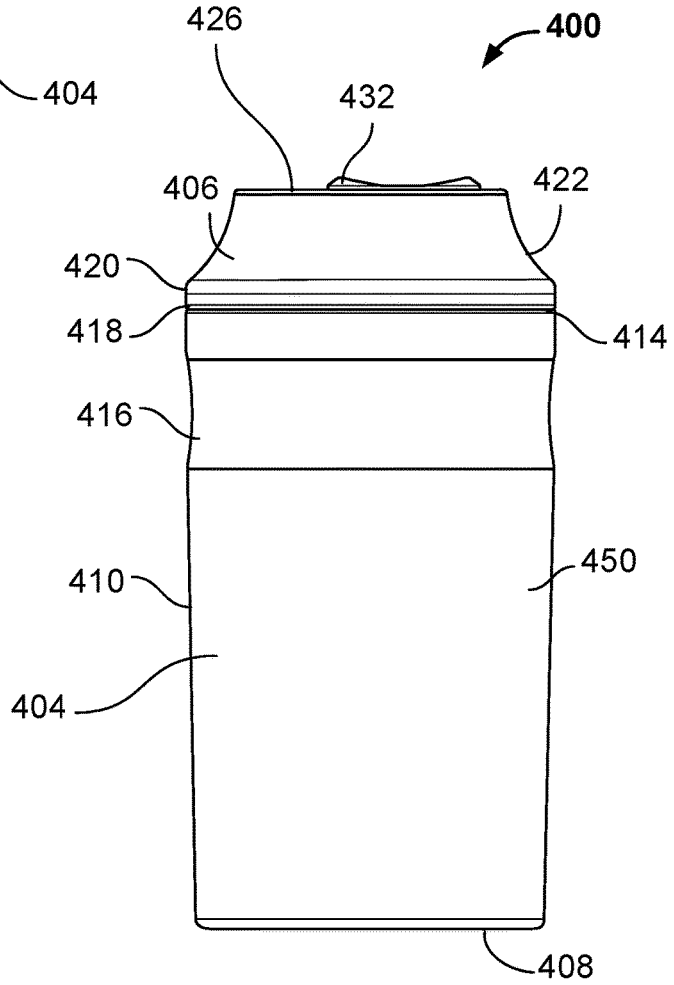
FIG. 31 is a right elevational view of the beverage container enclosure of FIG. 24.

As shown in FIGS. 26 and 27, the base component 404 may have a circular base 408 and a cylindrical base sidewall 410 that extends upwardly therefrom. The circular base 408 may also include a concave, elevated (as viewed from beneath), or depressed surface 412 centrally disposed on a bottom side thereof (see FIGS. 26 and 27). The depressed surface 412 may provide increased stability to the container enclosure 400 when the container enclosure is placed on uneven ground and, even further, the depressed surface 412 may reduce the potential of heat transfer or potential condensation damage to a surface beneath the container enclosure 400.

The base sidewall 410 extends generally straight upward or perpendicular from the circular base 408 to a shoulder 414; however, as best shown in FIGS. 28-31, the base sidewall 410 has a slight outward taper. In some embodiments, as shown in FIGS. 28-31, the base sidewall 410 extends straight upward near a top end thereof and provides a seamless transition between the base component 404 and the cap component 406. In alternative embodiments, such as that shown in FIGS. 5-8, the base sidewall 410 may taper near a top region thereof and the shoulder 414 of the base component 404 may taper inwardly. Similarly, the base sidewall 410 may taper near a bottom region thereof and, as best shown in FIGS. 28-32, the circular base 408 may taper inwardly. In other embodiments, the base sidewall 110 may extend straight downward to the circular base 408.

Further, as shown in FIG. 26, the base sidewall 410 may have a lower, initial diameter D4 and an upper, final diameter D5 that is that is slightly larger than the lower, initial diameter D4. The base sidewall 410 may also include an annular groove 416 proximate a top end thereof. In this embodiment, the annular groove 416 is a concave surface that extends around an entire outer perimeter or circumference of the base sidewall 410. In alternative embodiments, the annular groove 416 may only extend around a portion of the base sidewall 410, such as only along a left and right side of the base sidewall 410 proximate a top end of the base sidewall 410. In effect, the annular groove 416 may provide a recessed surface that a user may grip during use to hold the container enclosure 400. The base sidewall 410 may also include other recessed surfaces or grooves and/or regions with projections or ribs. In these embodiments, the diameter of the base sidewall 410 may be variable or may have areas of varying diameter between the circular base 408 and the shoulder 414.

The base component 404 may be pressed, rolled, or molded from a metal. In some embodiments, the base component 404 may comprise a 304 stainless steel or 18/8 stainless steel material. In other embodiments, the base component 404 may comprise an aluminum, a copper, a zinc, a titanium, or magnesium material, or combinations thereof. The base component 404 may also be constructed or formed from a natural material, such as a rubber, wood, bamboo, or stone, or a crafted material, such as a ceramic, glass, or pottery material. In further embodiments, the base component 404 may be constructed or formed from a synthetic material, such as a synthetic rubber, a plastic, or a carbon fiber. It should be understood that the materials listed above are merely representative and non-limiting, and the base component 404 may also be constructed from alternative materials. The base component 404 may be formed of a single unitary piece of material, or in alternative embodiments, the base component 404 may comprise multiple materials or multiple separate pieces joined together. For example, the base sidewall 410 may be constructed from a 304 stainless steel or 18/8 stainless steel material and the annular groove 416 may be constructed from a synthetic material, e.g., a synthetic rubber, to assist with gripping the container enclosure 400.

As briefly discussed above, the cap component 406 may be configured to attach and detach from the base component 404. As such, when in an assembled configuration such as that shown in FIGS. 24-31, the cap component 406 fits over and around a top of the base component 404 to enclose a beverage container (e.g., the beverage container 402) within the container enclosure 400. Further, as will be further discussed herein, the container enclosure 400 may protect the beverage container 402 from a temperature change, puncture, loss of carbonation, and/or spills by providing thermal insulation, cushion, and a durable exterior when assembled.

Turning back to FIGS. 24 and 25, the cap component 406 may have a generally cylindrical shape and, more particularly, the cap component 406 may have a circular base 418 (see FIGS. 28-31), with a cylindrical sidewall 420 extending upwardly therefrom. The sidewall 420 extends generally straight upward or perpendicular from the circular base 418 to a tapered neck 422 that angles or tapers inwardly toward a top surface 424 that is surrounded by an annular ridge 426. As best shown in FIGS. 28-31, the tapered neck 422 is a smooth, concave surface. With continued reference to FIGS. 28-31, the sidewall 420 may also taper inward near a bottom end thereof, or in alternative embodiments, the sidewall 420 may extend straight downward and may connect or contact an upper surface of the base sidewall 410 to provide a seamless transition between the base component 404 and the cap component 406, as shown in FIGS. 28-31.

With particular reference to FIG. 25, the cap component 406 may have a first diameter D6 and a second diameter D7. In particular, the first diameter D6 may be a diameter of the circular base 408 and/or the sidewall 410, which may be relatively equal or the same between the circular base 408 and the tapered neck 422, and the second diameter D7 may be a diameter of the top surface 424, which may be smaller than the first diameter D6. Further, in this embodiment, the tapered neck 422 provides a transition between the sidewall 420 having the first diameter D6 and the top surface 424 having the second diameter D7.

The cap component 406 may also include an opening or mouth 430 that may transition between an open configuration (e.g., see FIGS. 24, 25, and 41A) and a closed position (e.g., see FIG. 41B) using a sliding tab 432, which may slide between a forward position (e.g., see FIG. 41B) to close the opening 430 and a rearward position (e.g., see FIGS. 24, 25, and 41A) to open the opening 430. As such, when the opening 430 is in an open position and the sliding tab 432 is in a rearward position, a user may drink from a beverage within the beverage container or can 402 housed or enclosed within the container enclosure 400 through the opening 430 without removing the beverage container 402 from the container enclosure 400. In addition, when the opening 430 is in a closed position and the sliding tab 432 is in a forward position, the sliding tab 432 may provide a first seal that seals an interior cavity 448 (see FIG. 33) of the container enclosure 400 from the outside, exterior environment. In this manner, as will be further discussed herein, the container enclosure 400 (and the sliding tab 432 thereof) provides a first seal that protects the beverage container 402 from a temperature change, puncture, loss of carbonation, and/or spillage.

The cap component 406 may be molded, pressed, or sewn from an open or closed-cell foam. In this illustrated embodiment, the cap component 406 is molded from Acrylonitrile Butadiene Styrene (ABS). In other embodiments, the cap component 406 may be constructed or formed from natural materials, e.g., wood, bamboo, stone, crafted materials, e.g., pressboard or glass, or other synthetic materials, e.g., rubber, plastic, nylon, silicon, polycarbonate, polyvinyl chloride (PVC), polylactic acid (PLA), or other thermoplastics. It should be understood that the aforementioned materials are merely representative and non-limiting. The cap component 406 may be constructed from other materials or a combination of elements or a combination of materials. For example, in some embodiment, the tapered neck 422, the sidewall 420, and/or the top surface 424, may be molded as separate pieces and/or individual materials, and subsequently joined to form the cap component 406. In alternative embodiments, the cap component 406 is molded as a single, unitary piece.

Figure 32:
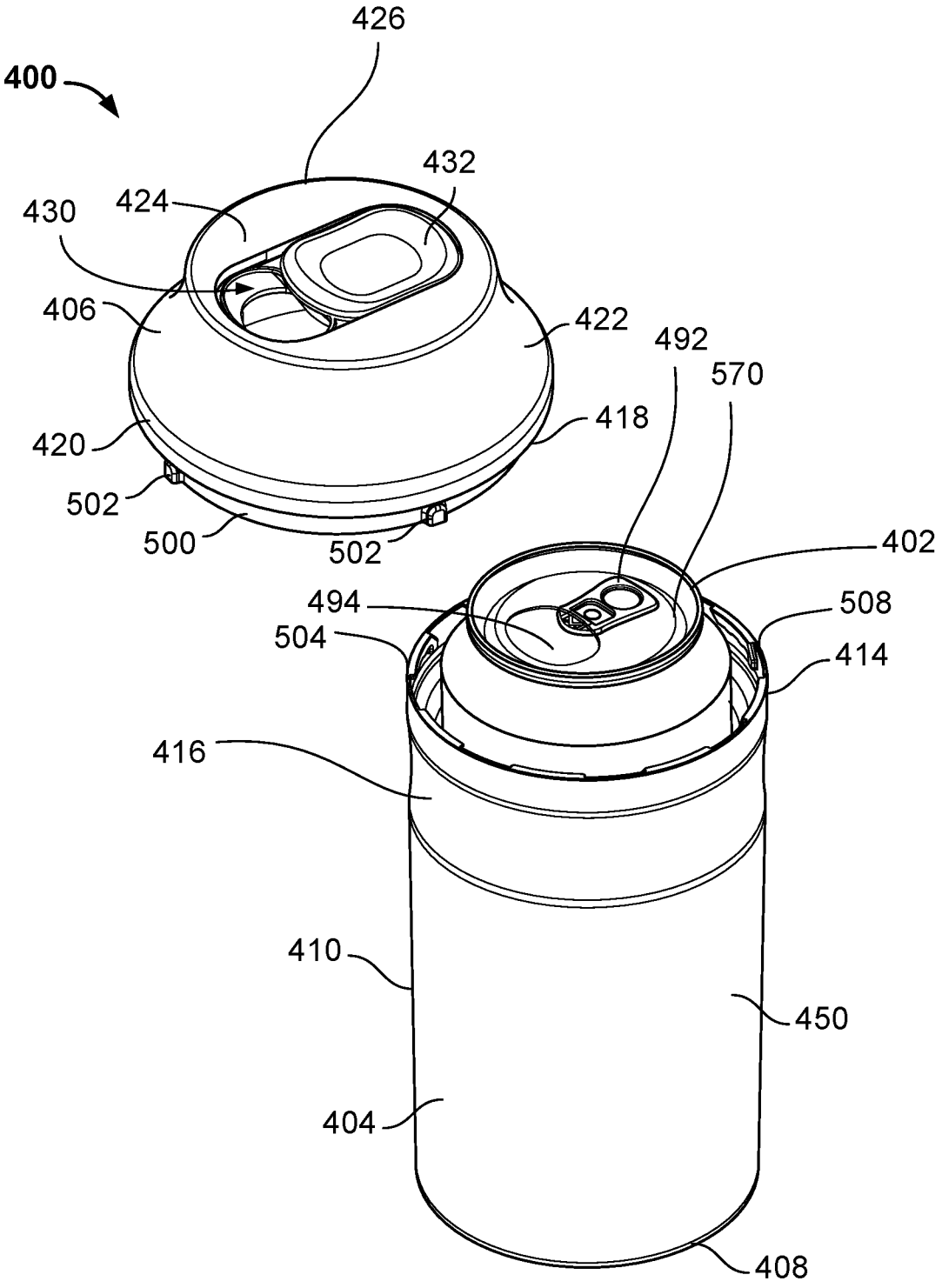
FIG. 32 is a top, right, and front isometric view of the beverage container enclosure of FIG. 24 in a disassembled or detached configuration, the beverage container having a base component and a cap component, and wherein a beverage container is positioned within the base component of the beverage container enclosure.
Figure 33:
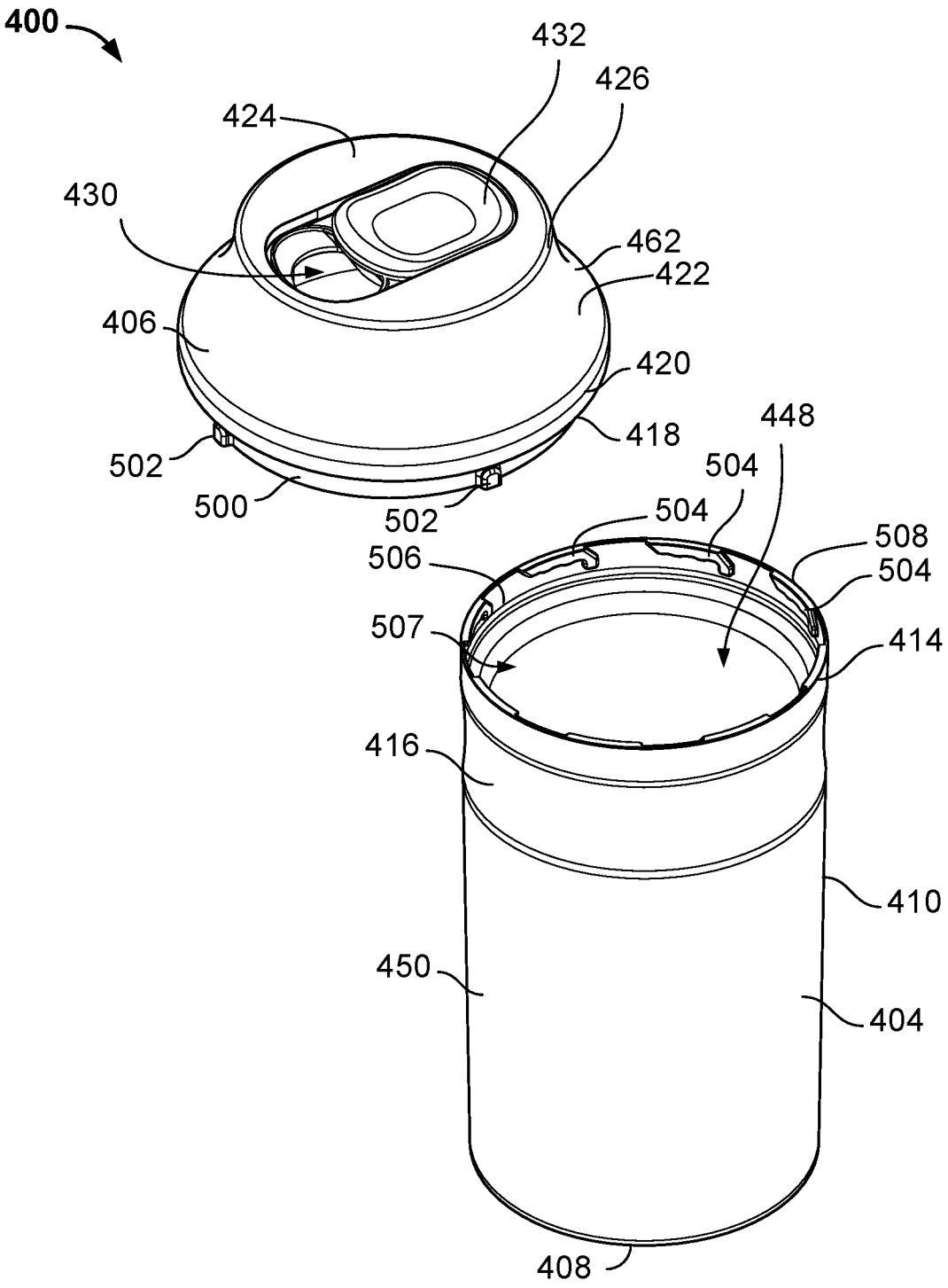
FIG. 33 is a top, right, and front isometric view of the beverage container enclosure of FIG. 33 in a disassembled or detached configuration, wherein the beverage container has been removed from the base component of the beverage container enclosure.
Figure 34:
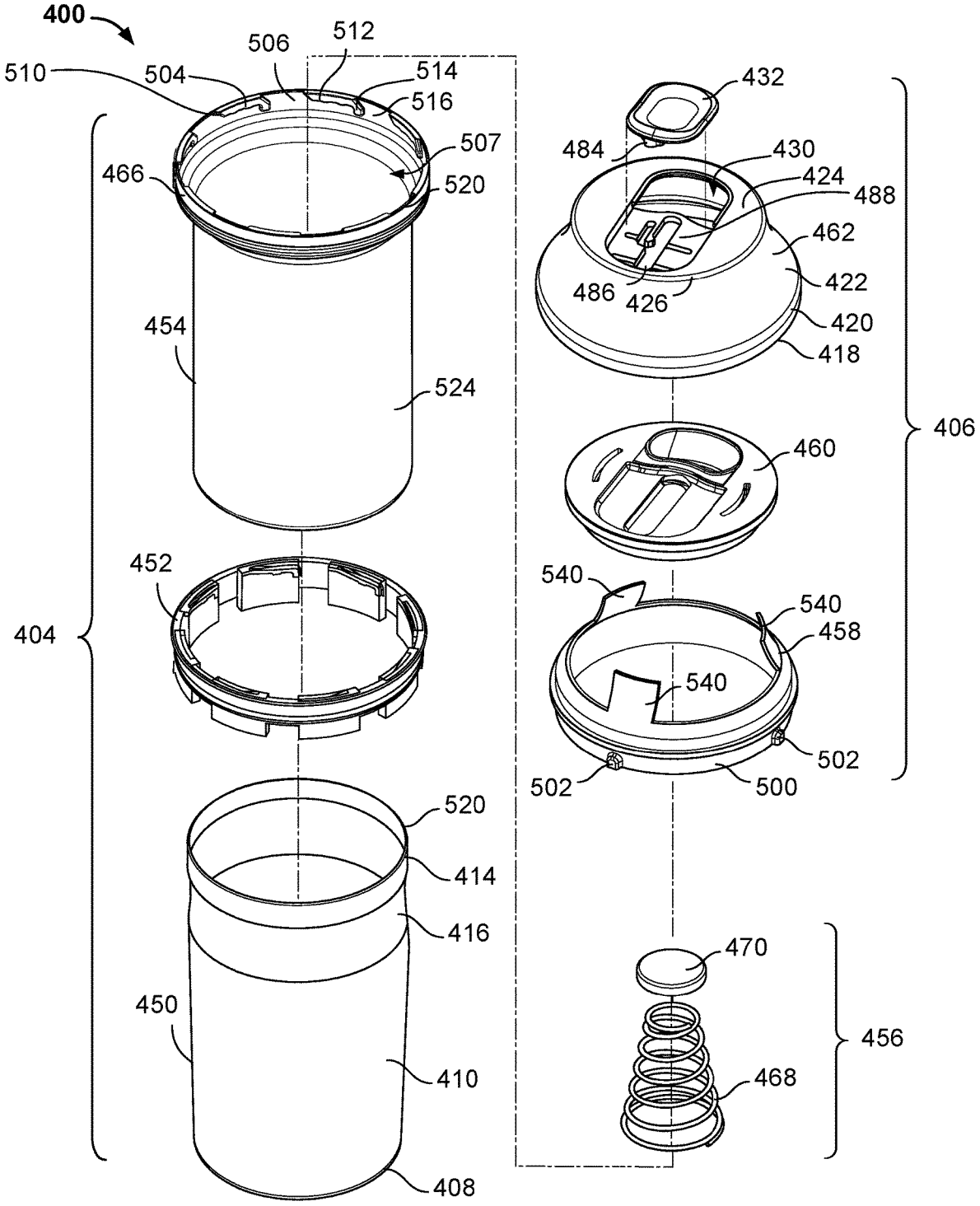
FIG. 34 is an exploded view of the beverage container enclosure of FIG. 24.

Turning now to FIGS. 32-34, the container enclosure 400 is depicted in a disassembled or detached configuration, both with the beverage container 402 within the base component 404 of the container enclosure 400 (see FIG. 32) and with the beverage container 402 removed from the container enclosure 400 (see FIG. 33). As shown in FIG. 34, the base component 404 may include an outer shell 450, a support ring 452, an interior sleeve 454, and a spring assembly 456, and the cap component 406 may include a lower ring assembly 458, a gasket 460, a cap shell 462, and the sliding tab 432. More particularly, with continued reference to FIG. 34, the support ring 452 may fit around an upper end 466 of the interior sleeve 454, the interior sleeve 454 may fit within the outer shell 450 and the outer shell 450 may fully or partially encase the interior sleeve 454 therein, and the spring assembly 456, which includes a spring 468 and a top cap 470 seated thereon, may be positioned within the interior sleeve 454 around a circular bump 472 on a bottom surface 474 of the interior sleeve 454 (see FIGS. 35A, 35B, and 36). Alternatively, if the base component 404 does not include the interior sleeve 454, the spring assembly 456 may be positioned within the outer shell 450 on a bottom interior surface 481 (see FIG. 38) of the outer shell 450. Further, the lower ring assembly 458 may be positioned within an interior cavity 480 of the cap shell 462, the gasket 460 may be attached to a top interior surface 482 of the cap shell 406 (as will be further discussed herein), and the sliding tab 432 may include a tab rail 484 that fits and cooperates with a groove 486 within a depression 488 on the top surface 424 of the cap shell 462.

When the base component 404 and the cap component 406 are separated, the interior cavity 448 of the base component 404 (see FIG. 33) and the interior cavity 480 (see FIGS. 44 and 45) of the cap component 406 are exposed. In such configurations, the beverage container 402, e.g., a cold beer can, may be inserted into or removed from the interior cavity 448 of the base component 404. For example, a user may first separate the base component 404 from the cap component 406 to expose the interior cavity 448 (as shown in FIG. 33). Next, a user may insert the beverage container 402 into the interior cavity 448 (as shown in FIG. 32). Then, a user may open the beverage container 402, e.g., by lifting a can tab 492 to puncture and open a mouth 494 of the beverage container 402, and subsequently attach the cap component 406 on a top end of the base component 408 by aligning the mouth 494 of the beverage container 402 with the opening 430 of the cap component 406 and rotating the cap component 406, as will be further discussed herein.

In particular, as shown in FIGS. 32, 33, 41A, and 41B, the lower ring assembly 458 of the cap component 406 may include a lower annular wall 500 that projects downward from the circular base 418, and one or more tabs 502 disposed around a perimeter or circumference of the lower annular wall 500. For example, in this embodiment, the cap component 406 includes four tabs 502 equally spaced around the lower annular wall 500 that are proximate a front, rear, left, and right side of the cap component 406. With continued reference to FIGS. 32 and 33, the interior sleeve 454 of the base component 404 may also include one or more locking features 504 on an interior surface 506 of the interior sleeve 454 (or base component 404), which may cooperate with the tabs 502 to lock the cap component 406 onto the base component 404. More particularly, the locking features 504 may be spaced around a circumference of the interior wall 506 of the interior sleeve 454 (or base component 404) and may be proximate a top opening 507 of the interior sleeve 454 or the base component 404. In particular embodiments, the locking features 504 may also be flush with a top surface 508 of the base component 404.

The locking features 504 may be evenly spaced around a circumference of the interior wall 506 and, as best shown in FIG. 34, each of the locking features 504 may individually have a ramped surface 510 near a front end thereof, one or more notches 512, and an end wall 514 near a rear end thereof. Furthermore, a space 516 may be present between the locking features 504, which allows the tabs 502 of the cap component 406 to be inserted or positioned therebetween. In particular, to attach the cap component 406 with the base component 404, a user may first align the tabs 502 of the cap component 406 with the spaces 516 and, when a beverage container 402 is positioned within the base component, a user may also slightly offset the opening 430 with the mouth 494 of the beverage container 402. Next, a user may lower the cap component 406 so that the tabs 502 are positioned in the spaces 516 and between the locking features 504. Then, a user may rotate the cap component 406 in a clockwise direction, as necessary, so that the opening 430 is aligned with the mouth 494 of the beverage container 402 and the tabs 502 are positioned within one of the notches 512 of the locking features 504 (see FIGS. 35A, 35B, and 36).

During use, the one or more notches 512 may allow for one or more secure positions of the cap component 406 with the base component 404, as the cap component 406 is rotated relative to the base component 404. As such, the notches 512 allow the cap component 406 to be rotated so that the opening 430 may be properly and easily aligned with the mouth 494 of the beverage container 402, while still maintaining a secure connection with the base component 404. In this particular embodiment, the locking features 504 include three notches 512, which provide three secure positions or three degrees of rotation of the cap component 406, once the cap component 406 engages the locking features 504. However, in alternative embodiments, the locking features 504 may include any number of notches. Further, the end wall 514 of the locking features 504 prevents over rotation of the cap component 406 relative to the base component 404, and may cease clockwise rotation of the cap component 406 relative to the base component 404.

With particular reference to FIGS. 34-39, the base component 404 may include an outer shell 450, a support ring 452, an interior sleeve 454, and a spring assembly 456. The outer shell 450 of the base component 404 may also generally define the exterior shape of the base component 404 and, as such, the shell 450 may include the circular base 408, the base sidewall 410, the shoulder 414, etc. Further, the interior sleeve 454 may be configured to be inserted into and sit within the interior cavity 448 of the base component 404 and, during use, the sleeve 454 may provide friction and pressure to keep or maintain the beverage container 402 within the shell 450, unless the beverage container 402 is intentionally removed or violently jostled.

Figure 35A:
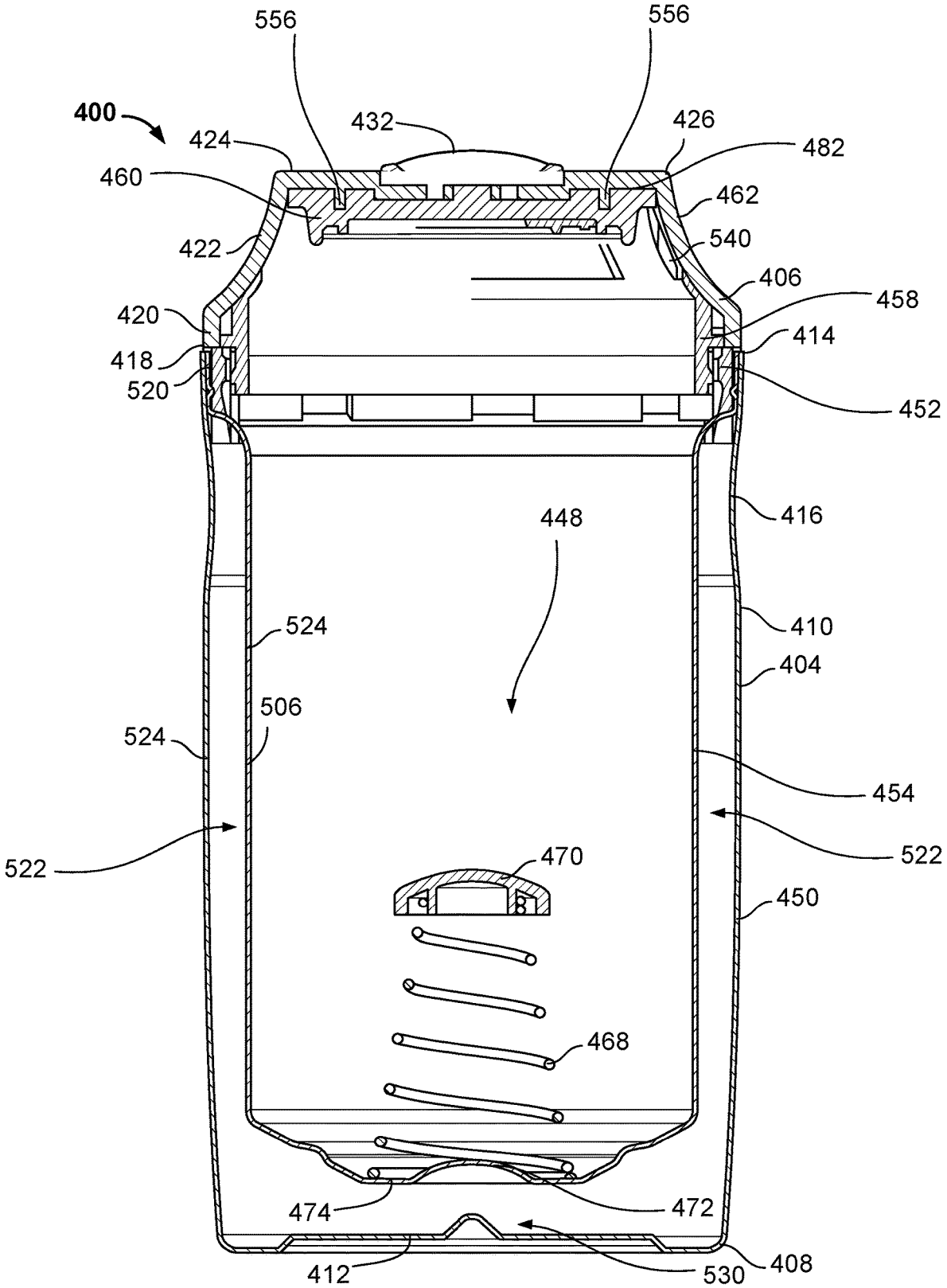
FIG. 35A is a front elevational cross-sectional view of the beverage container enclosure of FIG. 25, taken along lines 35-35 thereof.
Figure 35B:
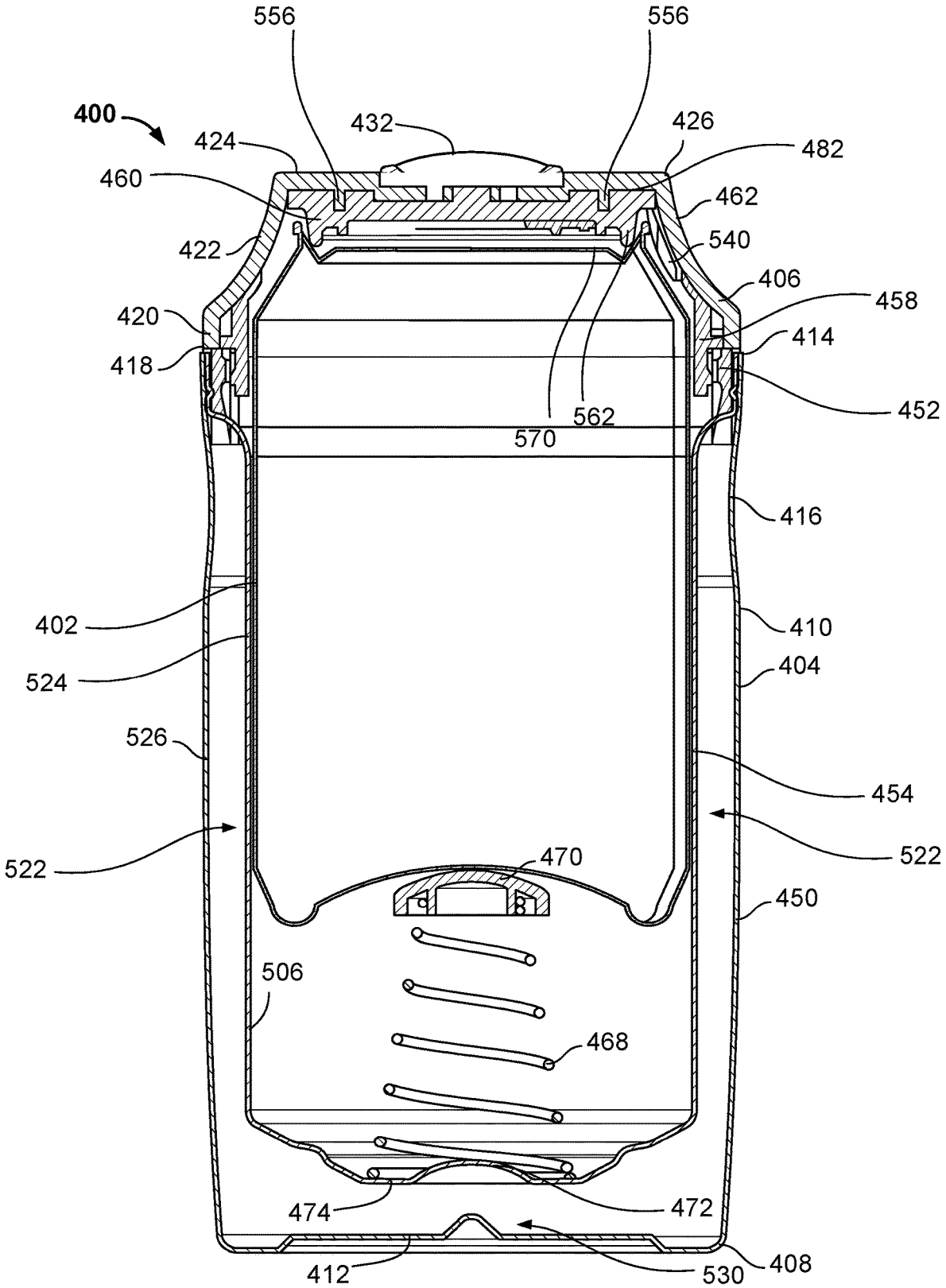
FIG. 35B is a front elevational cross-sectional view of the beverage container enclosure of FIG. 25, taken along lines 35-35 thereof, wherein a beverage container is within the beverage container enclosure.
Figure 36:
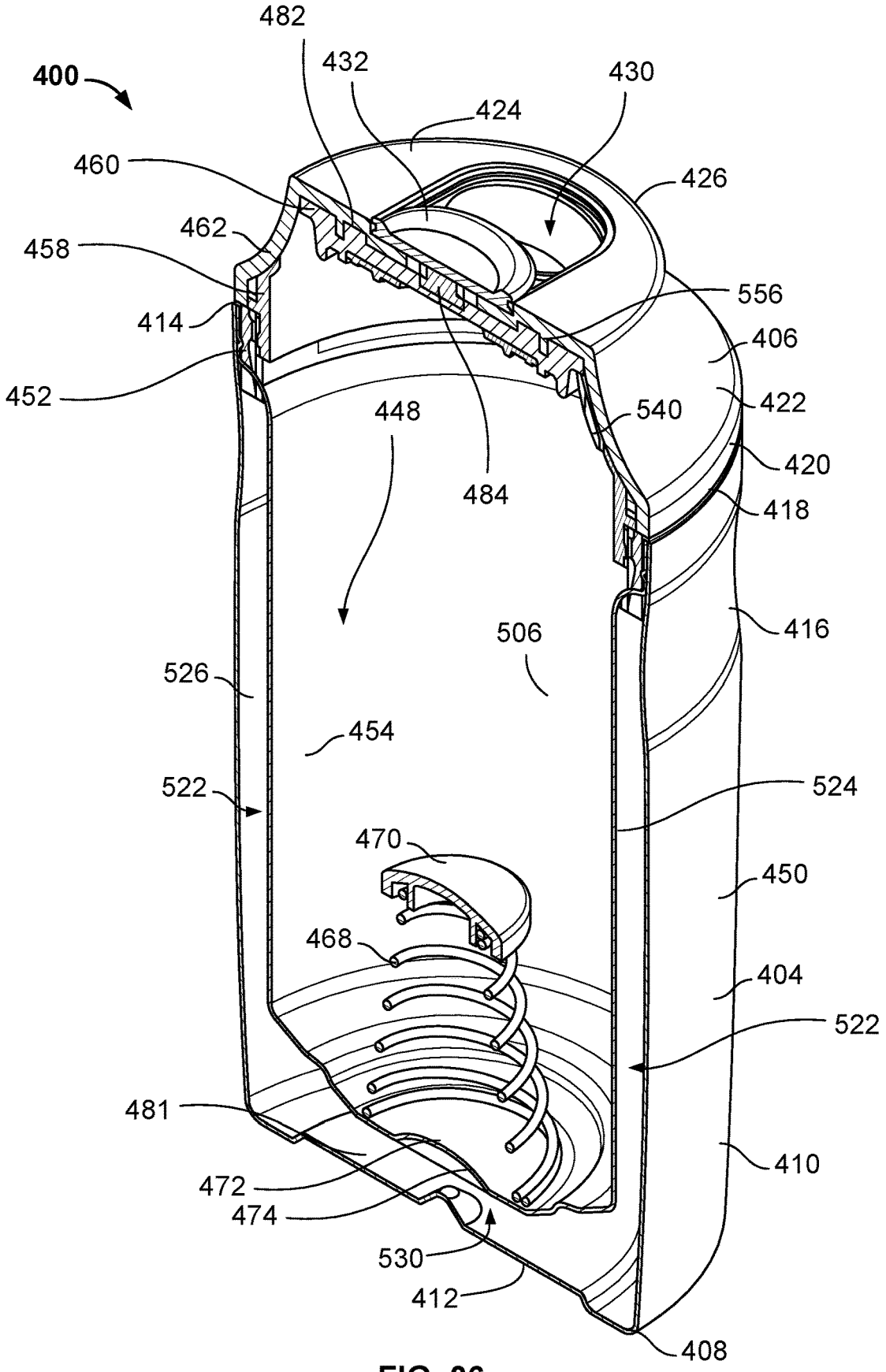
FIG. 36 is a top and front perspective view of the cross-sectional view of FIG. 35A.
Figure 37:
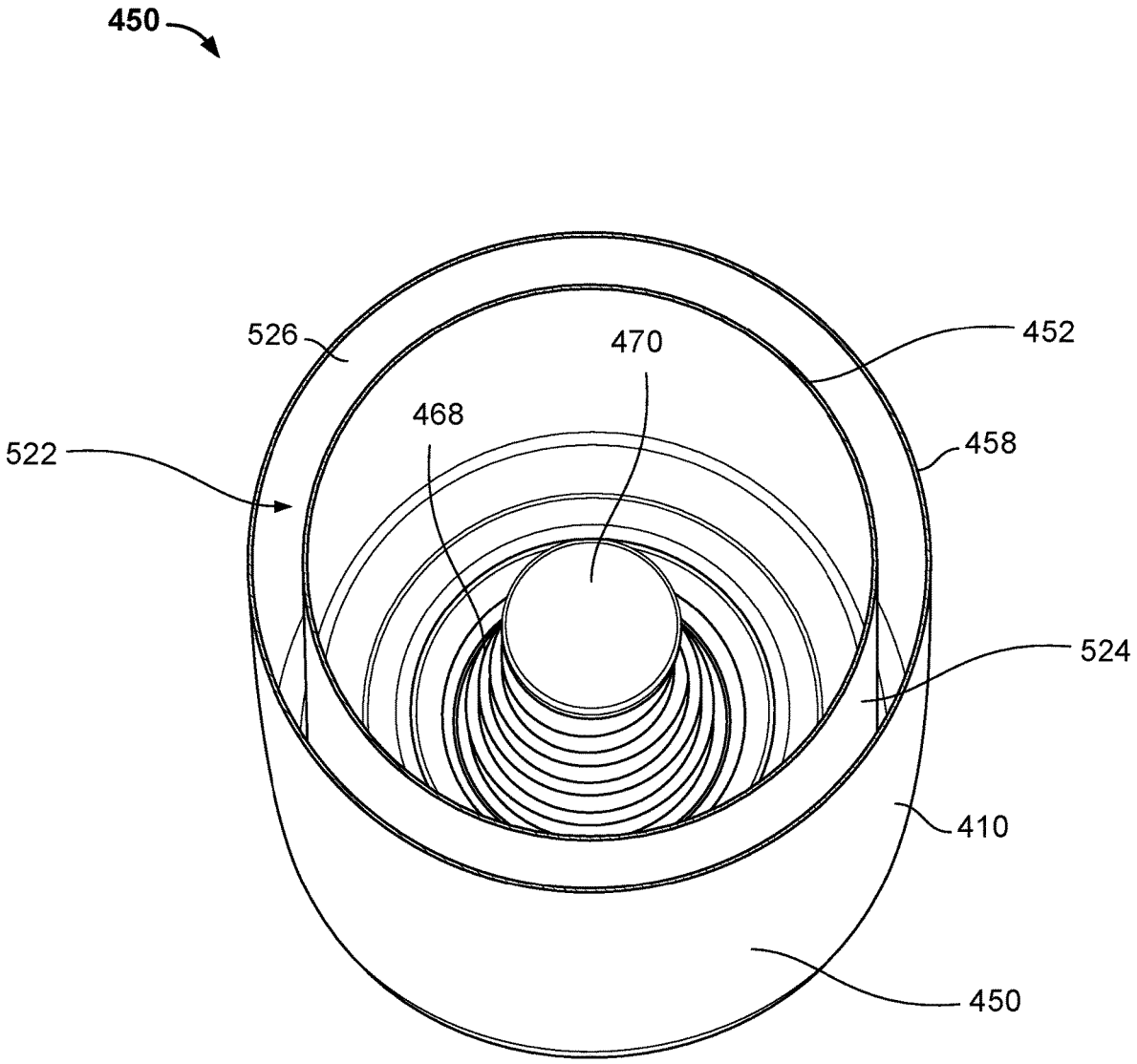
FIG. 37 is a cross-sectional view of the beverage container enclosure of FIG. 28, taken along lines 37-37 thereof.
Figure 38:
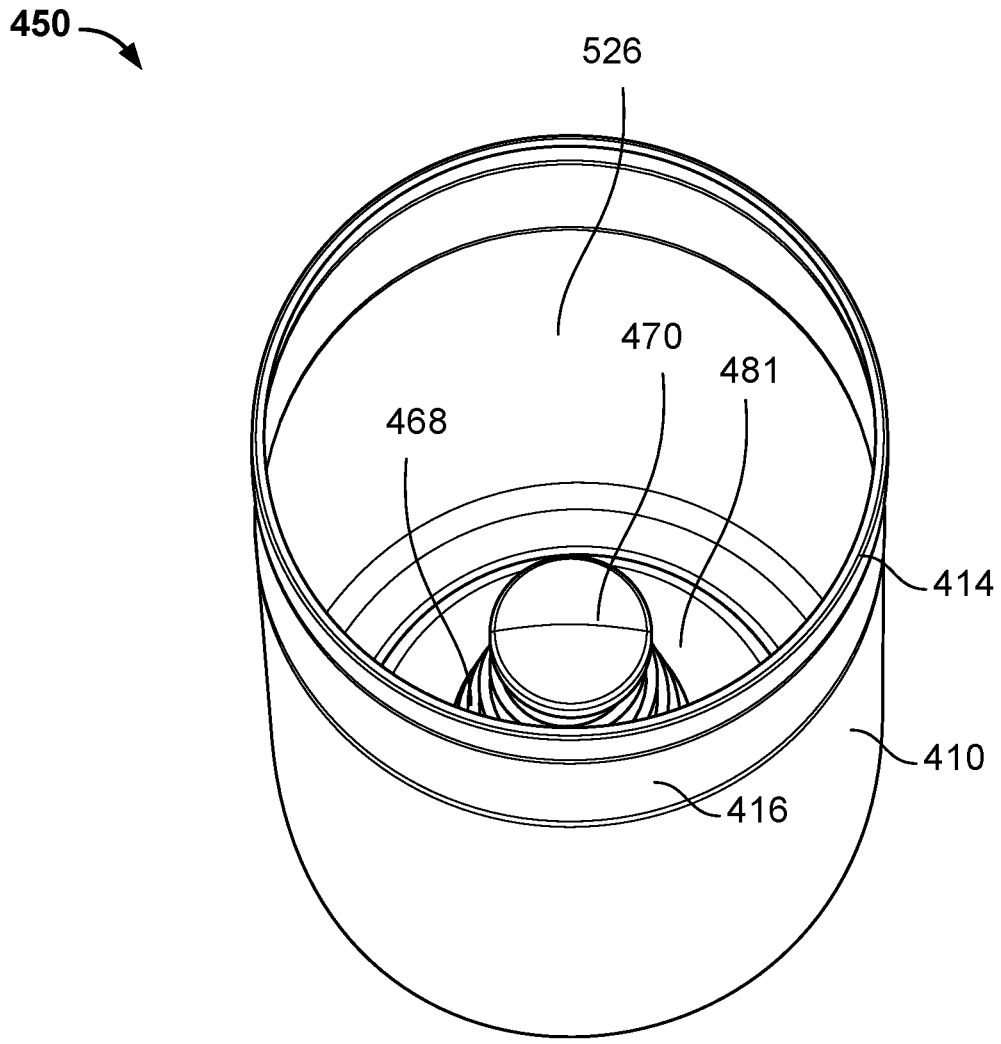
FIG. 38 is a top, right, and front perspective view of the base component of the beverage container enclosure of FIG. 24, according to an aspect of the present disclosure.
Figure 39:
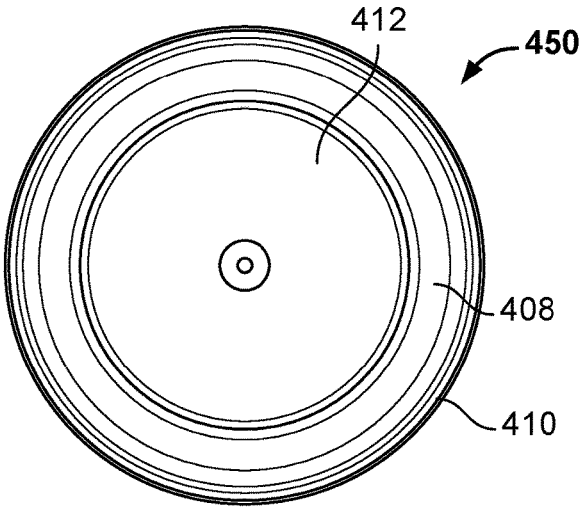
FIG. 39 is a bottom plan view of the base component of the beverage container enclosure of FIG. 24.
Figure 40:
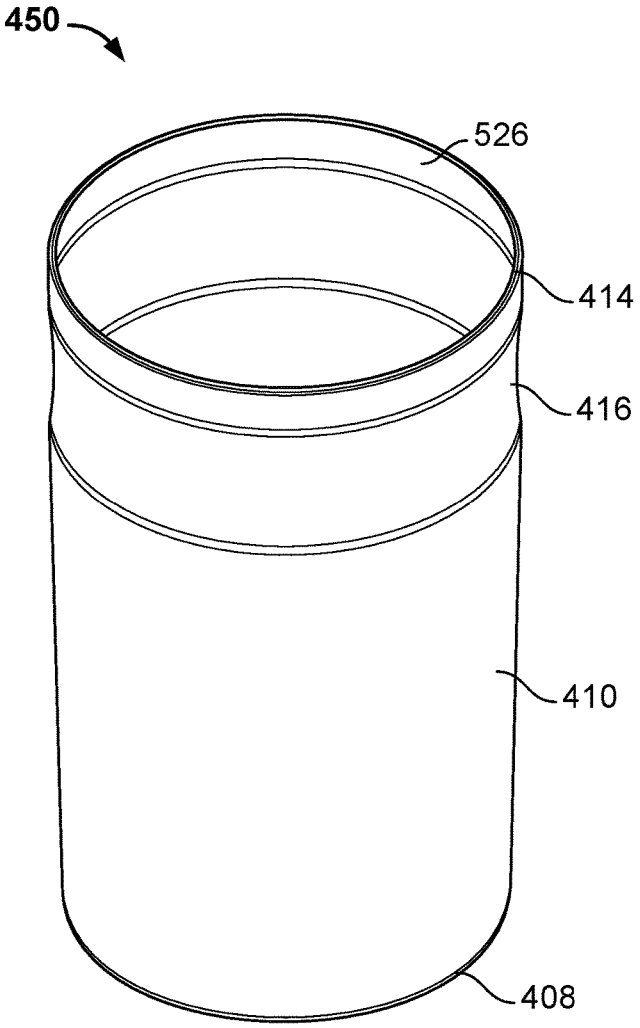
FIG. 40 is a top, right, and front isometric view of the base component of the beverage container enclosure of FIG. 24.

As previously discussed herein, the support ring 452 may fit around an upper end 520 of the interior sleeve 454 and, as best shown in FIGS. 35A and 35B, the support ring 456 may function to couple the interior sleeve 454 and the outer shell 450, once the interior sleeve 454 is inserted within the outer shell 450. In some embodiments, the support ring 452 and the interior sleeve 454 may be an integral component. The support ring 452 may also be configured to couple the interior sleeve 454 and the outer shell 150, while providing a spacing 522 (see FIGS. 35A, 35B, and 36) between an exterior wall 524 of the interior sleeve 454 and an interior wall 526 of the outer shell 450. As a result, when the beverage container 402 is inserted within the interior sleeve 454, a thermal conduction or heat transfer between the outer shell 450 and the beverage container 402 is minimized. The spacing 522 may be present between the interior wall 526 of the outer shell 450 and the exterior wall 524 of the interior sleeve 454 around a perimeter of the interior sleeve 454, and a spacing 530 may also be present between the bottom surface 474 of the interior sleeve 454 and the bottom interior surface 481 (see FIG. 36) of the circular base 408 of the outer shell 450. The interior sleeve 454 of the base component 404 may also be constructed from a material that is less rigid than the outer shell 450 and, in particular embodiments, may be constructed from an elastic material that may expand in size. For example, an interior volume of the interior sleeve 454 may be slightly smaller than a typical beverage container (e.g., the beverage container 402) and, as a result, may be configured to slightly expand when a beverage container is inserted therein to provide a pressurized fit that keeps or maintains the beverage container within the interior sleeve 454. Furthermore, the spacing 522 and the spacing 530 provides an area into which the interior sleeve 454 may expand.

As discussed above in connection with the base component 404, the outer shell 450 may be pressed, rolled, or molded from metal. In some embodiments, the outer shell 450 comprises a 304 stainless steel or 18/8 stainless steel material. In another embodiment, the outer shell 450 comprises aluminum, copper, zinc, titanium, or magnesium materials. The outer shell 450 may instead be made of natural materials, e.g., rubber, wood, bamboo, or stone, crafted materials, e.g., ceramic, glass, or pottery, or synthetic materials, e.g., synthetic rubber, plastic, carbon fiber. It should be understood that this material list is merely representative and non-limiting. The shell 450 may be constructed of other materials. The outer shell 450 may be formed of a single unitary piece of material, or alternatively, the outer shell 450 may alternatively comprise multiple materials or multiple separate pieces joined together.

In some embodiments, the interior sleeve 454 is free to rotate within the outer shell 450 and, in other embodiments, the interior sleeve 454 may be secured to the outer shell 450 (or the support ring 452) by injection molding or with an adhesive, for example. In yet another embodiment, the sleeve 454 is a thermally insulating tube. Further, as shown in FIGS. 35-38, the spring assembly 456 may be positioned within the interior sleeve 454 around the circular bump 472 on the bottom surface 474 of the interior sleeve 454. The spring assembly 456 includes the spring 468 and the top cap 470, and during use, a bottom of a container (e.g., the beverage container 402 in FIG. 35B) may be seated on the top cap 470 and the spring assembly 456 may elevate the container such that the container contacts and engages the gasket 460. Further, the spring assembly 456 may function to elevate a container out of the base component 404 when the cap component 406 is removed from the base component 404 to assist with removal of the container from the container enclosure 400. Even further, the spring assembly 456 allows the container enclosure 400 to enclose containers of varying sizes therein.

The interior sleeve 454 may be molded, pressed, or sewn from an open or closed-cell foam. For example, in this illustrated embodiment, the sleeve 454 is made of closed-cell neoprene foam. The interior sleeve 454 may be alternatively constructed or formed from natural materials, e.g., wood, bamboo, leather, or suede, crafted materials, e.g., fabric, paper, cardboard, or synthetic materials, e.g., rubber, plastic, nylon. The interior sleeve 454 may also be constructed of a thermally insulating material. It should be understood that this material list, and all material lists anywhere in this application, are merely representative and non-limiting. In other embodiments, the sleeve 454 may be constructed of other materials.

FIGS. 34 and 41-46 illustrate the cap component 406, which may fit over and around a top of the base component 404, as previously discussed herein. More particularly, the cap component 406 may include the lower ring assembly 458, the gasket 460, the cap shell 462, and the sliding tab 432.

As previously discussed herein, the annular wall 500 of the lower ring assembly 458 includes one or more tabs 502 that cooperate with the locking features 504 of the base component 404. With particular reference to FIG. 34, the lower ring assembly 458 may further include a plurality of upper tabs or extensions 540, which extend upward from the annular wall 500 of the lower ring assembly 458 such that once the lower ring assembly 458 is inserted within the interior cavity 448 of the outer shell 450, the upper tabs or extension 540 are flush with an interior surface 542 (see FIGS. 43 and 44) of the cap shell 462 and fit between a plurality of ridges 544 that extend from the interior surface 542. As such, the extensions 540 help properly align the lower ring assembly 458 within the cap shell 462.

Figure 41A:
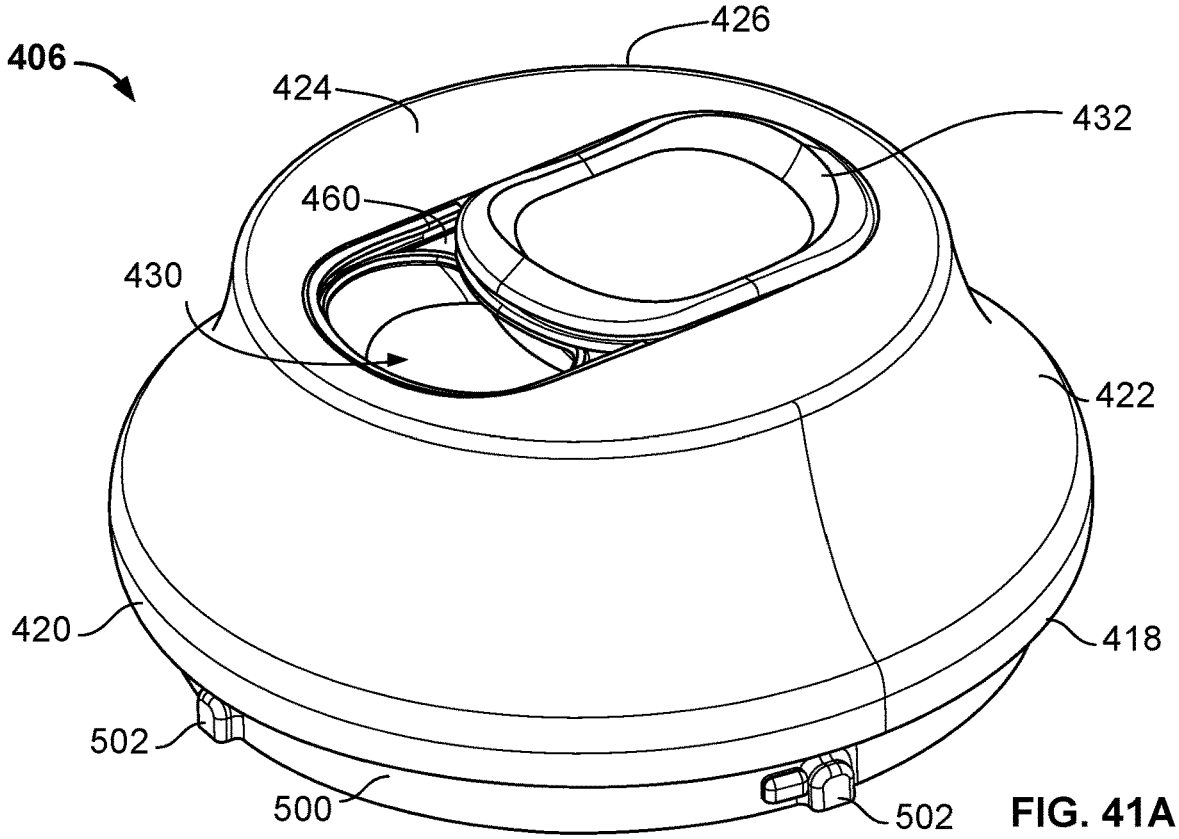
FIG. 41A is a top, right, and front isometric view of the cap component of the beverage container enclosure of FIG. 24, wherein the cap is in an open configuration.
Figure 41B:
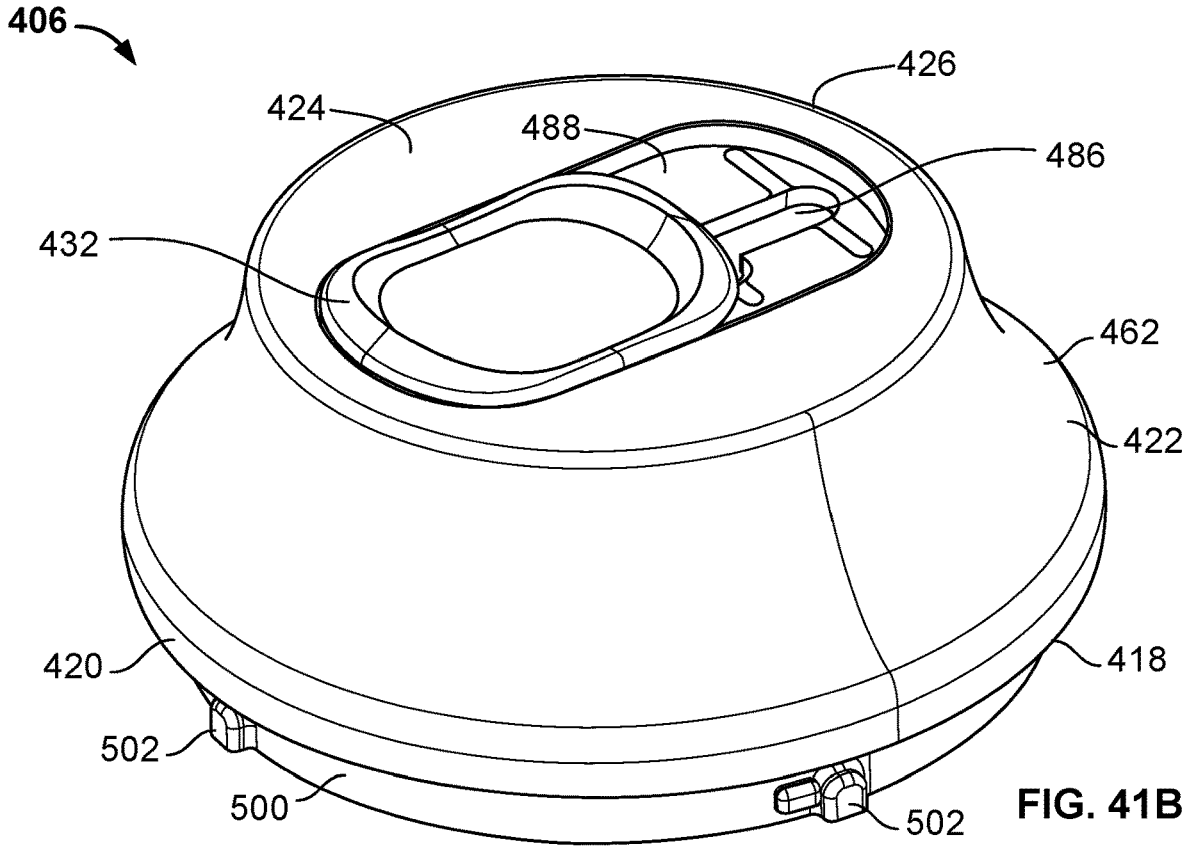
FIG. 41B is a top, right, and front isometric view of the cap component of FIG. 41A, wherein the cap component is in a closed configuration.
Figure 42:
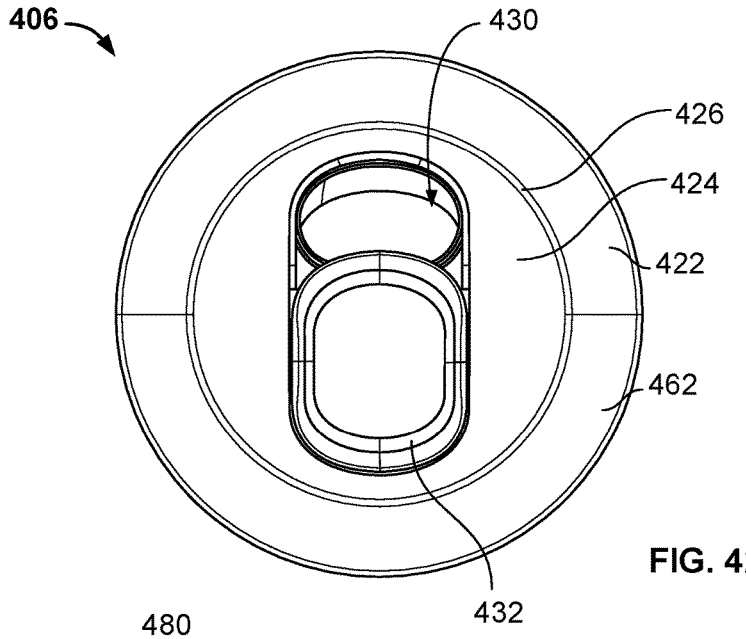
FIG. 42 is a top plan view of the cap component of FIG. 41A.
Figure 43:
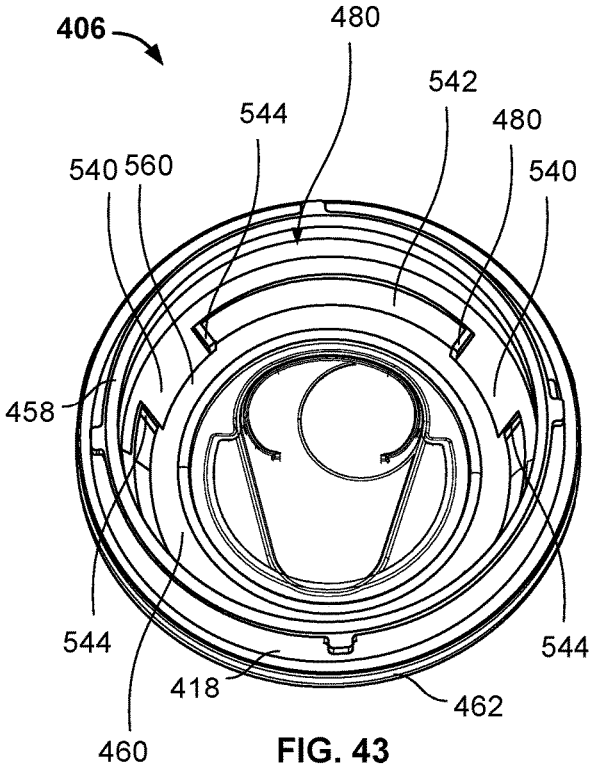
FIG. 43 is a bottom and rear perspective view of the cap component of FIG. 41A.
Figure 44:
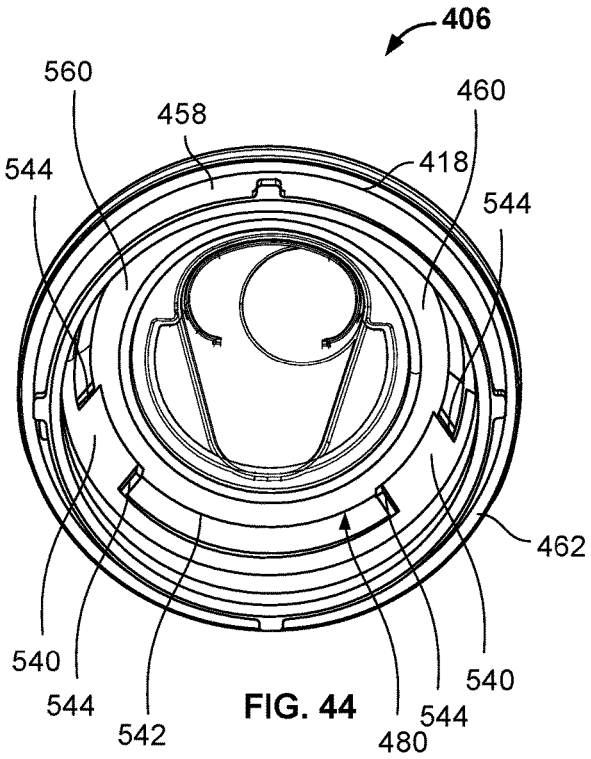
FIG. 44 is a bottom and front perspective view of the cap component of FIG. 41A.

Referencing FIGS. 41A, 41B, and 42, the cap shell 462 may generally define the exterior shape of the cap component 406 and, as such, the cap shell 462 may include the circular base 418, the cylindrical sidewall 420, the tapered neck 422, the top surface 424, and the annular ridge 426. And, with reference to FIGS. 43 and 44, the cap shell 462 includes an open bottom that provides access to the interior cavity 480 of the cap component 406, into which the lower ring assembly 458 and the base component 404 may be inserted.

Figure 45:
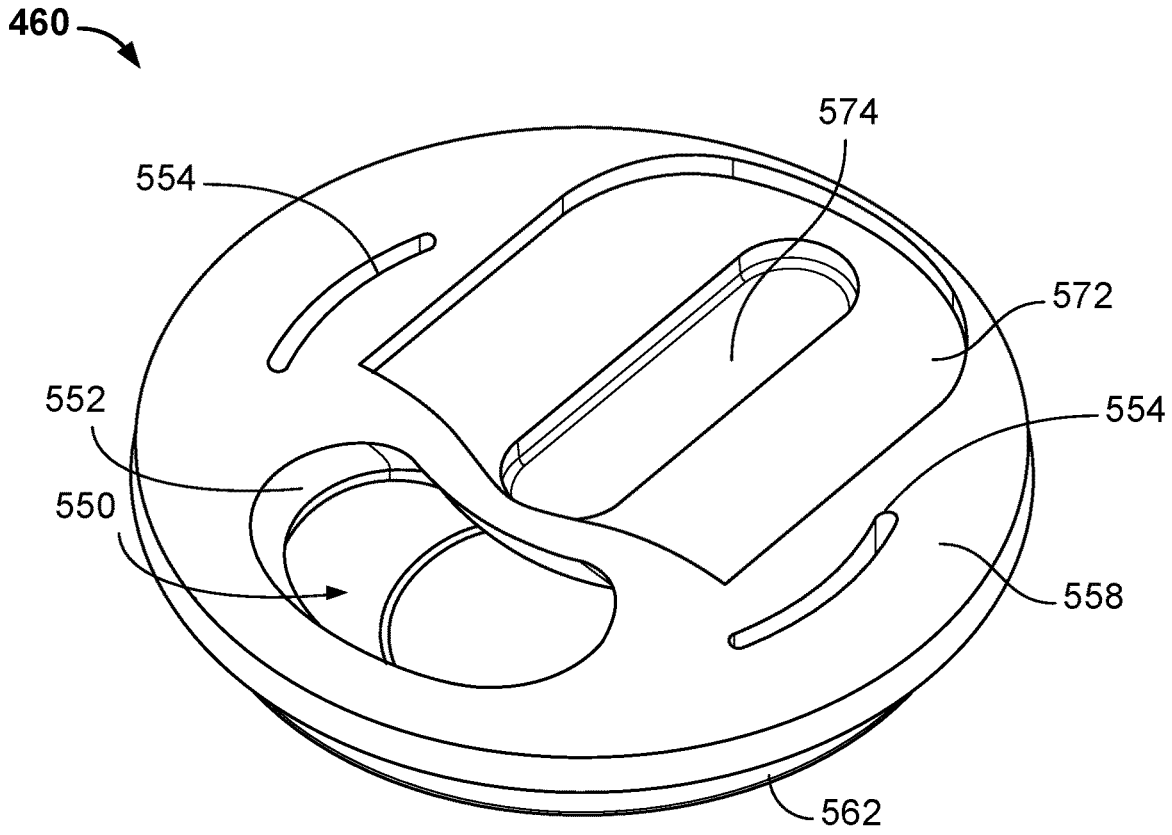
FIG. 45 is a top, right, and front isometric view of an insert or gasket of the beverage container enclosure of FIG. 24.
Figure 46:
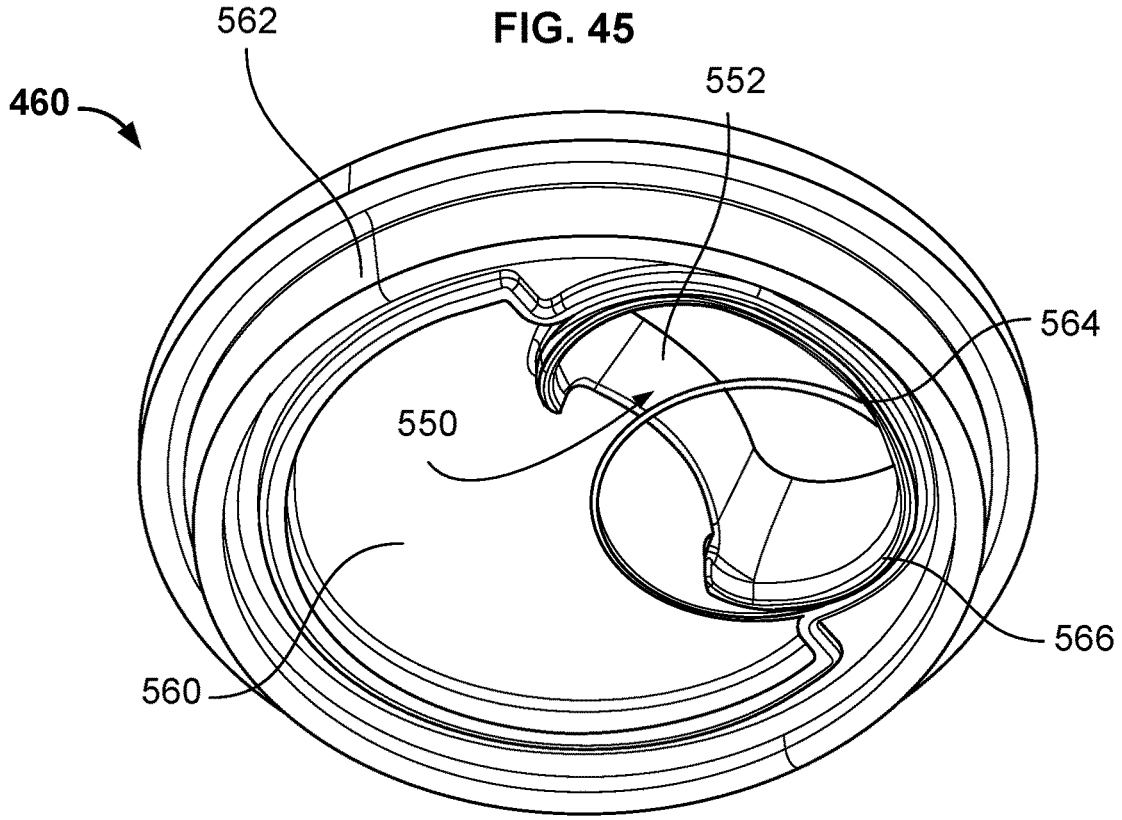
FIG. 46 is a bottom, left, and front isometric view of the insert or gasket of FIG. 45.

Turning to FIGS. 45 and 46, a detailed view of the insert or gasket 460 is shown. In this embodiment, the gasket 460 includes a gasket opening 550, which is defined by vertical, curved, or angled gasket mouth sidewalls 552 that are aligned with the opening 430. As such, the gasket mouth or opening 550 and the opening 430 may cooperatively function to direct liquid from the mouth 494 of the beverage container 402, through the gasket mouth or opening 550, and through the opening 430.

With continued reference to FIGS. 45 and 46, the gasket 460 may include one or more gasket divots 554 that may provide recesses into which cap protrusions 556 (see FIGS. 35A, 35B, and 36) may fit. In these embodiments, the cap protrusions 556 may extend from an underside of the top surface 424 of the cap shell 462 and may engage the gasket divots 554 to minimize the relative rotation of the gasket 460 and the cap shell 462. Further, as shown in FIGS. 45 and 46, the gasket divots 554 may be curved recesses that couple with a pair of complimentarily shaped and dimensioned cap protrusions 556. In alternative embodiments, any number of cap protrusions and gasket divots could be used, and the cap protrusions 556 and the gasket divots 554 may take any shape or be located on any portion of a top surface 558 of the gasket 460. Further, with reference to FIGS. 43 and 44, once the lower ring assembly 458 is inserted within the cap shell 462, the extensions 540 may contact and apply a force to a lower surface 560 of the gasket 460 to keep the gasket engaged with the cap shell 462.

Turning back to FIGS. 43 and 44, the gasket 460 may have a diameter that is smaller than an internal diameter of the cap shell 462, which enables the gasket 460 to fit inside the cap shell 462. The gasket 460 may also be removed from the cap shell 462 in some embodiments, and in other embodiments, the gasket 460 may be permanently affixed or removably secured to the cap shell 462. With reference to FIGS. 45 and 46, the gasket 460 may also include a gasket ring seal 562, a first gasket mouth seal 564, and a second gasket mouth seal 566. As such, if the cap component 406 is properly aligned relative to the beverage container 402 when attached to the base component 404, the gasket ring seal 562 may be inserted into a depression 570 of the beverage container 402 (see FIG. 35B) and, thereby, form a first boundary or seal with the beverage container 402. Additionally, when aligned, the first gasket mouth seal 564 may form a boundary or seal around the opening 430 and the mouth 494, and the second gasket mouth seal 566 may form another boundary or seal around the mouth 494 of the beverage container 402. In other embodiments, the second gasket mouth seal 564 is dimensioned to form a boundary or seal around an area atop a soda or beer can that includes the mouth 494 and the can tab 492. As further shown in FIG. 45, the gasket 460 may further include a groove depression 572 and a groove 574 that aligns with an underside of the depression 488 of the cap shell 462 and the groove 486 of the cap shell 462, thereby enabling the contours of the cap shell 462 and the gasket 460 to fit in a snug and cooperative arrangement.

In some embodiments, the gasket 460 may be molded, pressed, or constructed. In some embodiments, the gasket 460 is molded from silicon with a flexible 30A Shore hardness. The gasket or insert 460 may also be constructed of natural materials, e.g., rubber, wood, bamboo, plant fiber, sponge, crafted materials, e.g., fabric or pressed paper, or synthetic materials, e.g., synthetic rubber, plastic, nylon, or any other material with sufficient durability and flexibility to function as a gasket. It should be understood that this material list is merely representative and not limiting. The sleeve may be constructed of other materials.

Once assembled, the cap component 406 may include a mouth or opening 430 that transitions between an open position (see FIG. 41A), in which the opening 430 is exposed, and a closed position (see FIG. 41B), in which the opening 430 is covered, using a sliding tab 432. More particularly, FIG. 41A depicts the cap component 406 with the sliding tab 432 in the open position, while FIG. 41B depicts the cap component 406 with the sliding tab 432 in the closed position. Further, as noted above, the cap shell 462 may include the groove 486 positioned within the depression 488 on the top surface 424 of the cap shell 462, and the sliding tab 432 may include the tab rail 484 (see FIGS. 34 and 36) that fits and slides within the groove 486. As best shown in FIG. 34, the tab rail 484 may project from an otherwise flat or planar bottom surface (not shown), and may have a T-shaped cross-section, which fits within and cooperates with the similarly dimensioned groove 486. In such embodiments, the groove 486 may also have a T-shaped cross-section. In other embodiments, alternate sliding attachment configurations may be employed.

The sliding tab 432 may slide forward to a closed position and backward to an open position in the depression 488, which is an approximately rounded rectangular depression around the opening 430 and the sliding tab 432. During use, the sliding tab 432 can provide a boundary against excessive spills into or out of the beverage can enclosure when in a closed position. In some embodiments, the sliding tab 432 creates a watertight seal over the cap mouth, preventing any external spills. In some embodiments, the bottom surface of the sliding tab 432 may also include a gasket (not shown) configured to create a watertight seal around the mouth 494 of the beverage container 402 when the sliding tab 432 is in the closed position. In some embodiments, sliding tab 432 may also include a tab lock (not shown), which maintains the sliding tab 432 in a closed position unless the tab lock is disengaged. In some embodiments, the sliding tab 432 may also include an opener (not shown), such that when the sliding tab 432 is initially moved from the closed position to the open position, the opener extends through the gasket opening 550, applying pressure to the metal flap over the mouth 494 of the beverage container 402, and automatically opening the beverage container 402 inside the container enclosure 100.

The sliding tab 432 may be molded, pressed, or sewn from an open or closed-cell foam. In one illustrated embodiment, the sliding tab 432 is molded from Acrylonitrile Butadiene Styrene (ABS) in a similar fashion as the cap shell 462. The sliding tab 432 may be constructed from the same material as cap shell 462 or a different material from cap shell 462. The sliding tab 432 may also be made of natural materials, e.g., wood, bamboo, or stone, crafted materials, e.g., pressboard or glass, or other synthetic materials, e.g., rubber, plastic, nylon, silicon, polycarbonate, polyvinyl chloride (PVC), polylactic acid (PLA), or other thermoplastics. It should be understood that this material list is merely representative and non-limiting. The sliding tab 432 may be constructed of other materials or a combination of materials.

Although various aspects are herein disclosed in the context of certain preferred embodiments, implementations, and examples, it will be understood by those skilled in the art that the present invention extends beyond the specifically disclosed embodiments to other alternative embodiments and/or uses of the inventive aspects and obvious modifications and equivalents thereof. In addition, while a number of variations of the aspects have been noted, other modifications, which are within their scope, will be readily apparent to those of skill in the art based upon this disclosure. It should be also understood that the scope of this disclosure includes the various combinations or sub-combinations of the specific features and aspects of the embodiments disclosed herein, such that the various features, modes of implementation and operation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A container enclosure for removably enclosing a container, the enclosure comprising:
- a base component defining a first cavity and comprising:
  - an outer shell having a base wall and a sidewall extending upwardly therefrom;
  - a support ring; and
  - an interior sleeve, and
- a cap component comprising:
  - a lower annular wall; and
  - a gasket,
- wherein the gasket is disposed within a second cavity defined by the cap component,
- wherein the gasket includes an aperture that is aligned with an opening of the cap component,
- wherein the lower annular wall of the cap component is configured to be inserted into the first cavity of the base component and the cap component is configured to be removably attached to the base component,
- wherein the support ring is disposed around an upper end of the interior sleeve,
- wherein the interior sleeve is removably coupled to the support ring, and
- wherein the interior sleeve is configured to receive a beverage container.

2. The container enclosure of claim 1, wherein the first cavity has a larger volume than the second cavity.

3. The container enclosure of claim 1, wherein a sleeve sidewall of the interior sleeve defines a circular cross section.

4. The container enclosure of claim 1, wherein the interior sleeve is configured to be rotated within the first cavity.

5. The container enclosure of claim 1, wherein the interior sleeve and the outer shell of the base component comprise different materials.

6. The container enclosure of claim 1, wherein the interior sleeve is disposed entirely within the base component.

7. The container enclosure of claim 1, wherein the interior sleeve includes a plurality of locking features evenly and radially spaced along the upper end.

8. The container enclosure of claim 1, wherein the support ring is configured to fit around a portion of the lower annular wall of the cap component.

9. The container enclosure of claim 1, wherein the base component defines a first gap between an exterior wall of the interior sleeve and an interior wall of the outer shell.

10. The container enclosure of claim 1, wherein the base component includes a second gap between a lower surface of the interior sleeve and a lower surface of the outer shell.

11. The container enclosure of claim 10, wherein the base component further includes a spring assembly.

12. The container enclosure of claim 1, wherein the gasket is a disc-shaped gasket having a gasket ring seal, a first gasket mouth seal, and a second gasket mouth seal.

13. A container enclosure for removably enclosing a container, the enclosure comprising:
- a base component; and
- a cap component configured to be removably coupled to the base component,
- wherein the base component further comprises:
  - an outer shell having a base wall and a sidewall extending upwardly therefrom;
  - a support ring positioned at a top end of the base component and coupled to the outer shell; and
  - an interior sleeve configured to be removably inserted within an interior cavity of the base component,
- wherein the interior sleeve includes an upper end, the upper end having a plurality of locking features extending from an upper surface thereof,
- wherein the cap component includes an opening and a closure configured to transition between an open position and a closed position to open and close the opening, respectively, and
- wherein a gasket is disposed within a cap cavity formed by the cap component.

14. The container enclosure of claim 13, wherein the interior sleeve further comprises a lower end that is spaced apart from the base wall of the base component.

15. The container enclosure of claim 14, wherein both the upper end and the lower end of the interior sleeve are spaced apart from the outer shell of the base component.

16. The container enclosure of claim 13, wherein the support ring is configured to fit around a portion of a lower annular wall of the cap component.

17. The container enclosure of claim 13, wherein the interior sleeve is configured to receive and maintain a beverage container.

18. The container of claim 13, wherein the interior sleeve is configured to rotate within the base component.

19. The container enclosure of claim 13, wherein the support ring is configured to couple the interior sleeve to the outer shell of the base component.

20. The container enclosure of claim 13, wherein the interior sleeve is formed of a less rigid material than a material of the outer shell of the base component.

21. A container enclosure for removably enclosing a container, the enclosure comprising:

a base component comprising:

a support ring disposed at an upper end; and an interior sleeve disposed within an interior cavity of an outer shell of the base component, wherein the support ring is configured to removably couple the interior sleeve to the outer shell; and a cap component configured to be removably secured to the base component, wherein the interior sleeve includes an upper end, a lower end, and a sleeve wall having an exterior surface and an interior surface, the upper end comprising a plurality of locking features evenly spaced apart from each other, the exterior surface of the sleeve wall being spaced apart from an interior side of the outer shell, and the interior surface of the sleeve wall being configured to fit around a beverage container, wherein the cap component includes an open bottom defined by a lower annular wall, the lower annular wall being configured to fit within the base component, a cap cavity extending between a top surface and the open bottom, the cap cavity having a smaller volume than a volume of the interior cavity, and an opening and a closure configured to transition between an open position and a closed position to open and close the opening, respectively, wherein a gasket is coupled to the top surface within the cap cavity, the gasket having an aperture that is aligned with the opening of the cap component, and wherein the container enclosure is configured to conceal the beverage container.

* * * * *